US010151994B2

(12) United States Patent
Mori et al.

(10) Patent No.: US 10,151,994 B2
(45) Date of Patent: Dec. 11, 2018

(54) IMAGE FORMING APPARATUS

(71) Applicant: CANON KABUSHIKI KAISHA, Tokyo (JP)

(72) Inventors: Kota Mori, Abiko (JP); Takeshi Fujino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/635,570

(22) Filed: Jun. 28, 2017

(65) Prior Publication Data

US 2018/0004113 A1 Jan. 4, 2018

(30) Foreign Application Priority Data

Jun. 30, 2016 (JP) ..... 2016-130933

(51) Int. Cl.
*G03G 15/02* (2006.01)

(52) U.S. Cl.
CPC ..... *G03G 15/0266* (2013.01)

(58) Field of Classification Search
CPC ..... G03G 15/0266
USPC ..... 399/50
See application file for complete search history.

(56) References Cited

U.S. PATENT DOCUMENTS

| | | | | |
|---|---|---|---|---|
| 5,671,468 | A | 9/1997 | Yamamoto et al. | |
| 8,867,939 | B2 | 10/2014 | Shibuya | |
| 2016/0363882 | A1* | 12/2016 | Nakayama | G03G 15/0266 |

FOREIGN PATENT DOCUMENTS

| | | | | |
|---|---|---|---|---|
| JP | 5-341626 | A | | 12/1993 |
| JP | 7-234619 | A | | 9/1995 |
| JP | 11-143294 | A | | 5/1999 |
| JP | 2003-323079 | A | | 11/2003 |
| JP | 2011180458 | A | * | 9/2011 |
| JP | 2012-132951 | A | | 7/2012 |
| JP | 2013-054110 | A | | 3/2013 |

* cited by examiner

*Primary Examiner* — Susan Lee
(74) *Attorney, Agent, or Firm* — Fitzpatrick, Cella, Harper & Scinto

(57) ABSTRACT

An image forming apparatus includes a photosensitive member, a charging roller, a voltage source, a current detecting member, and a setting portion configured to set the DC voltage applied to the charging roller in an image forming period on the basis of a detection result of the detecting member when a DC voltage less than a discharge start voltage is applied from the voltage source to the charging roller in a period other than the image forming period, wherein the setting portion sets the DC voltage so that an absolute value of the DC voltage when an absolute value of the detected current is a first value is larger than an absolute value of the DC voltage when the absolute value of the detected current is a second value smaller than the first value.

4 Claims, 12 Drawing Sheets

(a)

(b)

IMAGE FORMING APPARATUS

FIELD OF THE INVENTION AND RELATED ART

The present invention relates to an image forming apparatus of an electrophotographic type, an electrostatic recording type or the like, in which a charging device for electrically charging a photosensitive member is provided for forming an image on a recording material.

Conventionally, in the image forming apparatus of the electrophotographic type, in some cases, a charging roller is rotatably provided in contact with the photosensitive member and a voltage is applied to a core metal of the charging roller to cause minute electric discharge in the neighborhood of a contact nip between the charging roller and the photosensitive member and thus a surface of the photosensitive member is electrically charged. Herein, as regards the contact nip between the photosensitive member and the charging roller (charging member), with respect to rotational directions of these members, an upstream-side gap is referred to as an upstream charging gap portion Gu and a downstream-side gap is referred to as a downstream charging gap portion Gd (FIG. 2). Further, as a charging type, there are two types including a DC charging type in which a voltage applied to the charging roller is only a DC voltage and an AC+DC type in which the voltage applied to the charging roller is a superimposed voltage consisting of the DC voltage and an AC voltage.

(1) DC Charging Type

When the DC voltage is applied to the charging member, such as the charging roller, of a contact type and is increased, charging of the photosensitive member, such as a photosensitive drum, which is a member-to-be-charged is started. Thus, an applied voltage to the charging member when the charging of the photosensitive member is started under application of the DC voltage to the charging member is a charge start voltage Vth of the photosensitive member. After the charging of the photosensitive member is started, the applied DC voltage and a surface potential Vd of the charged photosensitive member are proportional to each other. Accordingly, in order to charge the photosensitive member to a desired surface potential Vd, a DC voltage of the +Vd which is the sum of the charge start voltage Vth of the photosensitive member and the desired surface potential Vd may only be required to be charged. Thus, the type in which the photosensitive member is charged by applying only the DC voltage to the charging member is referred to as the DC charging type.

(2) Lateral Stripe Due to Downstream Electric Discharge

In the DC charging type, there was a possibility that a stripe-shaped charging non-uniformity (charging lateral stripe) generates with respect to a longitudinal direction (perpendicular to a circumferential direction) of the photosensitive member due to non-uniformity of the surface potential Vd of the photosensitive member. It would be considered that the charging non-uniformity is caused due to generation of unstable peeling (electric) discharge at the downstream charging gap portion Gd (minute gap) with respect to the rotational direction of the photosensitive member after the surface of the photosensitive member is charged at the position charging gap portion Gu with respect to the rotational direction of the photosensitive member. Specifically, first, at the upstream charging gap portion Gu of the photosensitive member, in the case where an applied voltage Vpr=Vth+Vd to the charging member is satisfied and a relationship thereof is also maintained at the downstream charging gap portion Gd, the charging is completed, so that the unstable peeling discharge does not generate. In this case, also the charging lateral stripe does not generate.

However, in the case where the charging is not completed at the upstream charging gap portion Gu the (electric) discharge generates again at the downstream charging gap portion Gd. Similarly, even in the case where the surface potential Vd is dark-decayed at a contact portion (so-called a contact nip) between the charging member and the photosensitive member where the charging is completed but there is no discharge gap or in the like case, the discharge generates again at the downstream charging gap portion Gd. In these cases, when the potential difference in the downstream side is small, the charging non-uniformity generates by intermittent generation of unstable discharge, so that a lateral stripe-shaped image defect generates. On the other hand, when the potential difference in the downstream side is large, the discharge at the downstream charging gap is stabilized, so that due to the charging lateral stripe does not generate.

From the above, as a method of preventing the charging lateral stripe, there are two methods including a method in which the charging is always completed at the upstream portion and the surface potential is not dark-decayed and a method in which the potential difference at the downstream portion is increased and continuous and stable discharge is carried out. Here, when a moving speed of the photosensitive member becomes fast, it becomes difficult to complete the charging at the upstream portion with respect to the rotational direction. For this reason, in the case where speed-up of the image forming apparatus is carried out in order to further improve productivity of the image forming apparatus, it is difficult to employ the former method, and the latter method, i.e., the method in which the potential difference at the downstream portion is increased and the continuous and stable discharge is carried out, may preferably be employed.

Therefore, in Japanese Laid-Open Patent Application (JP-A) Hei 5-341626, an image forming apparatus, in which the charging lateral stripe generating when the photosensitive member is charged by the DC charging type is suppressed by canceling the charging of the photosensitive member at the upstream charging gap portion Gu, has been developed. In this image forming apparatus, of the charging gap portions generating by contact between the charging roller and the photosensitive member, at the upstream charging gap portion Gu with respect to the rotational direction of the photosensitive member, the photosensitive member is irradiated with light (pre-nip exposure). As a result, the charging of the photosensitive member is canceled at the upstream charging gap portion Gu and the photosensitive member is charged at the downstream charging gap portion Gd of the photosensitive member, so that the generation of the charging lateral stripe due to the peeling discharge can be suppressed.

(3) Lowering in Electric Resistance of Photosensitive Member Surface Due to Electric Discharge Product In the case of the contact charging type, compared with a corona charging type, a discharge amount is small, so that an amount of an electric discharge product such as ozone, NOx or the like is small. However, a generating position of the discharge product is a minute gap between the photosensitive member and the charging member, and therefore, the discharge product is liable to be deposited on the surface of the photosensitive member even when the generation amount is small. For that reason, in some cases, charging-retaining power at the surface of the photosensitive member lowers, so that image flow (image deletion) and image blur generate. That is, when the charging process of the photosensitive member is carried out by the contact charging member, the discharge product is deposited on the surface of the photosensitive member. The surface of the photosensitive member is not readily abraded because of a low friction coefficient and high hardness, and the discharge product deposited on the surface of the photosensitive member is not readily removed. For that reason, the discharge product accumulated on the surface of the photosensitive member absorbs moisture in a high-humidity environment and lowers an electric resistance of the photosensitive member surface, so that the image flow and the image blur generate.

In order to suppress the image flow and the image blur, JP-A H11-143294 proposes an image forming apparatus in which a heater is provided inside or in the neighborhood of the photosensitive member and the surface of the photosensitive member is dried by increasing a temperature of the photosensitive member surface. Further, JP-A 2003-323079 proposes an image forming apparatus in which the photosensitive member is excessively subjected to blank rotation to increase the number of times of friction per unit time between the photosensitive member and a blade or the like contacting the photosensitive member and thus the discharge product is removed. Further, JP-A H7-234619 proposes an image forming apparatus in which an abrading power of the photosensitive member by a cleaner blade is enhanced by supplying an abrasive to the surface of the photosensitive member and thus the discharge product is removed.

However, in the image forming apparatus proposed in JP-A H5-341626, the pre-nip exposure was carried out and a discharge current amount is increased by the influence of the pre-nip exposure, and therefore, there was a problem such that abrasion between the photosensitive member and the charging roller was accelerated and thus lifetimes of the photosensitive member and the charging roller were shortened. In the image forming apparatus proposed in JP-A H11-143294, the temperature of the photosensitive member was increased using the heater, and therefore, there was a problem such that even in the case where the image flow did not generate on the photosensitive member, the heater was operated so as to execute the temperature increase at predetermined timing in some instances and thus electric power consumption was large. In the image forming apparatuses proposed in JP-A 2003-323079 and JP-A H7-234619, the photosensitive member was excessively subjected to the blank rotation for removing the discharge product, and therefore, there was a problem such that productivity of the image forming apparatus lowered and the photosensitive member was excessively abraded and thus a lifetime of the photosensitive member was shortened.

SUMMARY OF THE INVENTION

According to an aspect of the present invention, there is provided an image forming apparatus comprising: a photosensitive member on which an electrostatic latent image is formed; a charging roller configured to electrically charge the photosensitive member in contact with the photosensitive member; a voltage source configured to apply only a DC voltage to the charging roller; a detecting member configured to detect a current flowing from the charging member into the photosensitive member; and a setting portion configured to set the DC voltage applied to the charging roller in an image forming period on the basis of a detection result of the detecting member when the DC voltage less than a discharge start voltage is applied from the voltage source to the charging roller in a period other than the image forming period, wherein the setting portion sets the DC voltage so that an absolute value of the DC voltage when an absolute value of the detected current is a first value is larger than an absolute value of the DC voltage when the absolute value of the detected current is a second value smaller than the first value.

Further features of the present invention will become apparent from the following description of exemplary embodiments with reference to the attached drawings.

DESCRIPTION OF EMBODIMENTS

First Embodiment

In the following, First Embodiment of the present invention will be specifically described with reference to FIGS. 1-5. In this embodiment, as an example of an image forming apparatus 1, a full-color printed or a tandem type is described. However, the present invention is not limited to the image forming apparatus 1 of the tandem type, but may also be an image forming apparatus of another type. Further, the image forming apparatus 1 is not limited to the full-color image forming apparatus, but may also be a monochromatic image forming apparatus or a single-color image forming apparatus. Or, the image forming apparatus 1 can be carried out in various uses such as printers, various printing machines, copying machines, facsimile machines and multi-function machines. Further, in this embodiment, the image forming apparatus 1 is of a type in which an intermediary transfer belt 44*b* is provided and composite toner images of respective colors are primary-transferred from photosensitive drums 51 onto the intermediary transfer belt 44*b* and thereafter are secondary-transferred altogether onto a sheet S. However, the present invention is not limited thereto, but may also employ a type in which the toner images are directly transferred onto a sheet fed by a sheet feeding belt.

The image forming apparatus 1 is capable of forming a four-color-based full-color image on a recording material depending on an image signal from a host device such as a personal computer or an external device such as a digital camera or a smartphone. Incidentally, on a sheet S which is a recording material, a toner image is to be formed, and specific examples of the sheet S include plain paper, a synthetic resin sheet as a substitute for the plain paper, thick paper, a sheet for an overhead projector, and the like.

Figure 1:
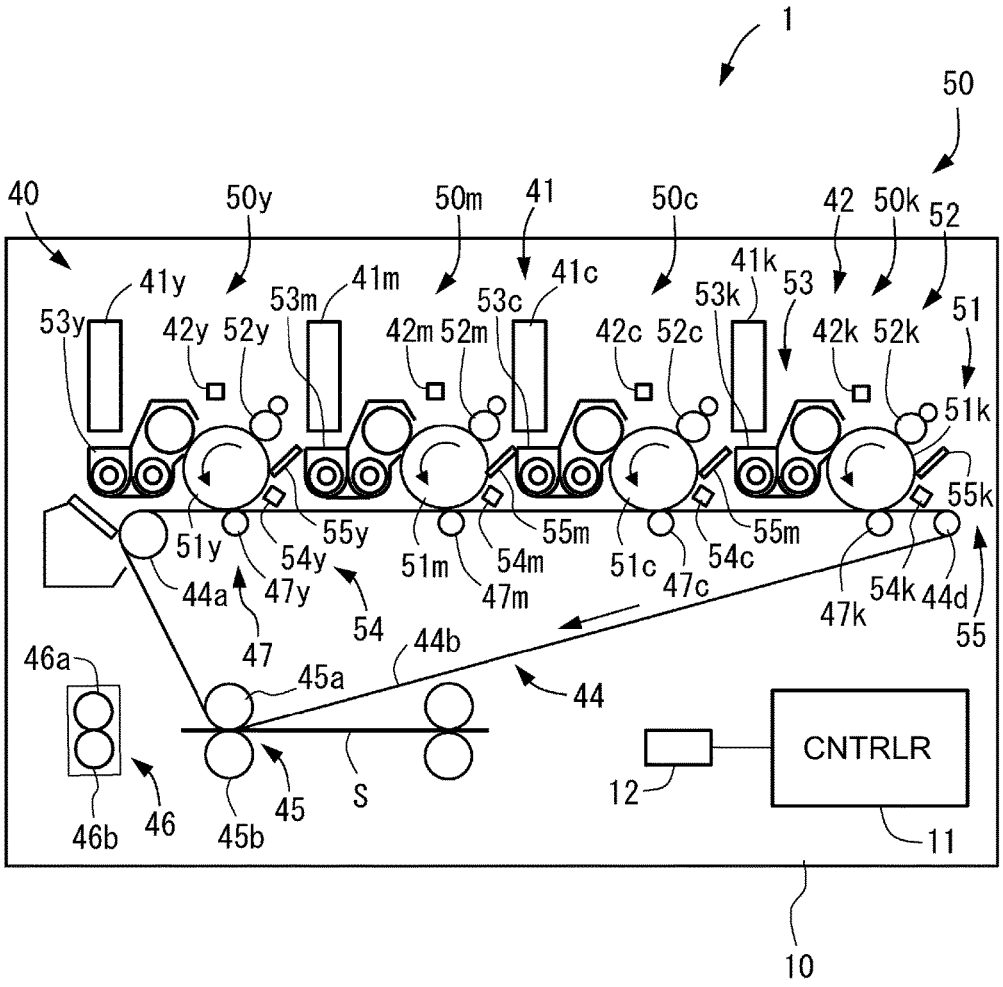
FIG. 1 is a sectional view showing a schematic structure of an image forming apparatus according to First Embodiment.

As shown in FIG. 1, the image forming apparatus 1 includes an apparatus main assembly 10, an unshown sheet feeding portion, an image forming portion 40, an unshown sheet discharging portion, a controller 11 and a temperature and humidity sensor (environment detecting portion) 12 capable of detecting a temperature and a humidity of an inside of the apparatus main assembly 10. The temperature and humidity sensor 12 is connected with the controller 11 and detects environment information including at least temperature and humidity of a periphery of a photosensitive drum 51 described later, and sends the detected environment information to the controller 11.

The image forming portion 40 is capable of forming, on the basis of image information, an image on a sheet S fed from a sheet feeding portion.

The image forming portion 40 includes image forming units 50*y*, 50*m*, 50*c* and 50*k*, toner bottles 41*y*, 41*m*, 41*c* and 41*k*, exposure devices 42*y*, 42*m*, 42*c* and 42*k*, an intermediary transfer unit 44, a secondary transfer portion 45 and a fixing portion 46. Incidentally, the image forming apparatus 1 in this embodiment is capable of forming a full-color image and includes the image forming units 50*y* for yellow (y), 50*m* for magenta (m), 50*c* for cyan (c) and 50*k* for black (k), which have the same constitution and which are provided separately. For this reason, in FIG. 1, respective constituent elements for four colors are shown by adding associated color identifiers to associated reference numerals, but in FIGS. 2 and 3 and in the specification, the constituent elements are described using only the reference numerals without adding the color identifier in some cases.

Figure 3:
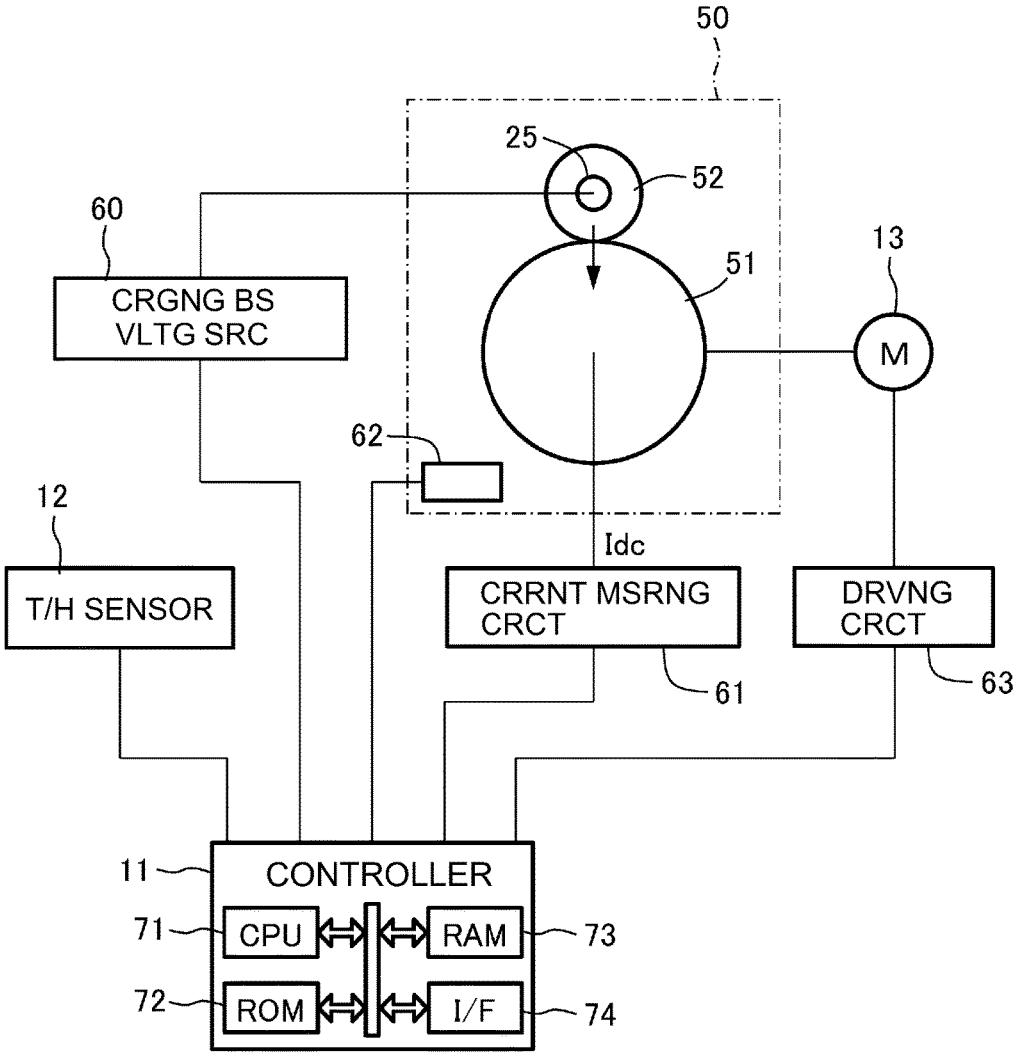
FIG. 3 is a schematic block diagram showing a control system of the image forming apparatus in First Embodiment.

The image forming unit 50 includes the photosensitive drum (photosensitive member) 51 for forming a toner image, a charging roller 52, a developing device 53, a pre-exposure device (discharging means) 54, a regulating blade 55 and a memory (storing portion) 62 (FIG. 3). The image forming unit 50 is an integral unit as a process cartridge and is constituted so as to be detachably mountable to the apparatus main assembly 10. For this reason, in the case where the photosensitive drum 51 reaches an end of a lifetime thereof by image formation on a predetermined number of sheets or in the like case, the image forming unit 50 can be exchanged or the like.

The photosensitive drum 51 is rotatable and an electrostatic image used for the image formation is formed on the photosensitive drum 51. The photosensitive drum 51 is rotated by a motor (driving means) 13, and the motor 13 is controlled by the controller 11 through a driving circuit 63 (FIG. 3). The photosensitive drum 51 is negatively chargeable organic photosensitive member (OPC) of 30 mm in outer diameter and is rotationally driven in an arrow direction at a process speed (peripheral speed) of 210 mm/sec, for example. With the photosensitive drum 51, a current value measuring circuit (current detecting means) 61 for detecting an injection current Idc which is a DC current injected from the charging roller 52 into the photosensitive drum 51 is connected (FIG. 3).

Figure 2:
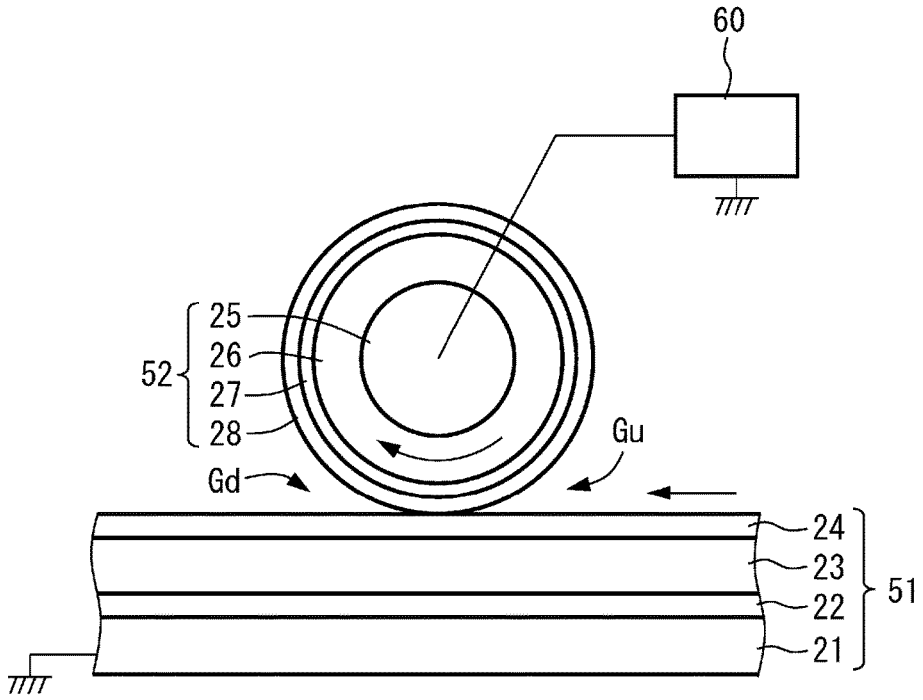
FIG. 2 is a sectional view showing schematic structures of a photosensitive drum and a charging roller of the image forming apparatus in First Embodiment.

As shown in FIG. 2, the photosensitive drum 51 includes an aluminum cylinder (electroconductive drum substrate) 21 as a substrate, and includes as surface layers, three layers consisting of an undercoat layer 22, a photo-charge generating layer 23 and a photo-charge transporting layer 24 which are successively applied and laminated in a named order on the aluminum cylinder 21. Each of the layers 22, 23 and 24 as the surface layers is a cured layer using a curable resin material as a binder resin. In this embodiment, as a surface curing process (treatment), the cured layer using the curable resin material was used, but the present invention is not limited thereto. For example, a charge transporting cured layer formed by, e.g., subjecting a monomer having a carbon-carbon double bond and a charge transporting monomer having a carbon-carbon double bond to curing polymerization with thermal or light energy may also be used. Or, a charge transporting cured layer or the like layer formed by, e.g., subjecting a hole transporting compound having a chain-polymerizable functional group in one molecule to curing polymerization with electron beam energy may also be used.

The charging roller 52 contacts the surface of the photosensitive drum 51 and uses a rubber roller rotated by the photosensitive drum 51, and electrically charges the surface of the photosensitive drum 1 uniformly. The charging roller 52 includes a core metal 25 as a base material, and on an outer surface of the core metal 25, three layers consisting of a lower layer 26, an intermediary layer 27 and a surface layer 28 which are laminated in a named order, and a length thereof with respect to an axial direction is 320 mm, for example. The lower layer 26 is a foam sponge layer for reducing a charging noise. The surface layer 28 is protective layer provided for preventing generation of leakage even when a defect such as a pin hole is formed on the surface of the photosensitive drum 51, and is formed in an uneven shape. By forming the surface layer 28 in the uneven shape, pressure between a recessed portion of the surface layer 28 and the photosensitive drum 51 is reduced, so that contamination of the charging roller 52 is alleviated. As a method of forming the surface layer 28 in the uneven shape, a method of incorporating fine particles into the surface layer 28, a method of mechanically polishing the surface layer 28 and the like method have been proposed.

In this embodiment, the charging roller 52 has the following specification.

(1) Core metal 25: stainless round bar of 6 mm in diameter (2) Lower layer 26: carbon (back)-dispersed foam EPDM of 0.5 g/cm$^3$ in specific gravity, $10^2$-$10^9$ Ωcm in volume resistance value and 3.0 mm in thickness (3) Intermediary layer 27: carbon (black)-dispersed NBR-based rubber of $10^2$-$10^5$ Ωcm in volume resistance value and 700 μm in thickness (4) Surface layer 28: "Toresin" (fluorine-containing compound) in which tin oxide and carbon black are dispersed, which is $10^7$-$10^{10}$ Ωcm in volume resistance value, 10 μm in thickness and 1.5 μm in surface roughness (10-point average surface roughness Ra according to JIS)

With the core metal 25 of the charging roller 52, a charging bias voltage source (voltage applying means) 60 is connected. As a result, to the core metal 25, a DC voltage is applied under a predetermined condition by the charging bias voltage source 60, so that the peripheral surface of the photosensitive drum 51 is contact-charged to a predetermined potential and a predetermined polarity. That is, the charging bias voltage source 60 applies, as the charging bias, the DC voltage to the charging roller 52, and charges the photosensitive drum 51 through the charging roller 52.

The charging is carried out by electric discharge from the charging roller 52 to the photosensitive drum 51, and therefore, the charging is started by applying a DC voltage of not less than a certain threshold voltage. In this embodiment, a surface potential Vd of the photosensitive drum 51 starts an increase under application of a DC voltage of not less than about −600 V, and thereafter increases linearly with a slope of 1 with respect to the applied voltage. For example, in this embodiment, in order to obtain the surface potential Vd of −300 V, the DC voltage of −900 V may only be required to be applied, and in order to obtain the surface potential Vd of −500 V, the DC voltage of −1100 V may only be required to be applied.

In this embodiment, the threshold voltage which increases linearly with the slope of 1 with respect to the applied voltage is defined as a discharge start voltage (charging start voltage) Vth. That is, in order to obtain the surface potential Vd (dark-portion potential) of the photosensitive drum 51 necessary for electrophotography, there is a need that a DC voltage of Vd+Vth which is not less than the required surface potential Vd is required to be applied to the charging roller 52. In this embodiment, during image formation, in order to uniformly charge the peripheral surface of the photosensitive drum 51 to the surface potential Vd=−500 V, the DC voltage of −1100 V is applied from the charging bias voltage source 60 to the charging roller 52.

As shown in FIG. 1, the exposure device (exposure means) 42 is a laser scanner and emits laser light in accordance with image information of separated color outputted from the controller 11. The surface of the photosensitive drum 51 is, after charging, subjected to exposure to light by the exposure device 42 on the basis of the image information of corresponding separated color, so that an electrostatic image (latent image) depending on the image information is formed on the surface of the photosensitive drum 51. The photosensitive drum 51 carries the formed electrostatic image and is circulated and moved.

The developing device 53 develops the electrostatic image, formed on the photosensitive drum 51, with toner under application of a developing bias. The developing device 53 is a reverse developing device of a two-component magnetic brush developing type and reversely develops the electrostatic (latent) image on the surface of the photosensitive drum 51 by depositing the toner on an exposed portion (light-portion potential portion) of the surface of the photosensitive drum 51. A developer in the developing container is a mixture of a non-magnetic toner with a magnetic carrier, and is fed toward a developing sleeve side while being uniformly stirred by rotation of two developer stirring members.

The toner image formed on the photosensitive drum 51 by developing the electrostatic image with the toner is primary-transferred onto an intermediary transfer belt 44*b* described later. The surface of the photosensitive drum 51 after the primary transfer is discharged by a pre-exposure device 54. The pre-exposure device 54 removes the potential remaining on the surface of the photosensitive drum 51 after the primary transfer and before the charging by subjecting the photosensitive drum surface to exposure to light through an exposure guide for diffusing the light from an exposure lamp provided in the apparatus main assembly. That is, the photosensitive drum 54 discharges the surface of the photosensitive drum 51 after the toner image formed by developing the electrostatic image with the toner is transferred. In this embodiment, the pre-exposure device 54 has a peak in an optical source wavelength of 400 nm-800 nm and is capable of controlling a light quantity on the surface of the photosensitive drum 51 in a range of 0.1 μW to 40 μW, and can adjust the light quantity by adjusting a voltage applied to the optical source. That is, the pre-exposure device 54 is an exposure means, and a discharge amount of a discharging means is an exposure amount of the pre-exposure device 54.

The regulating blade 55 is of a counter blade type and is an elastic blade which has a free length of 8 mm and which is principally formed of a urethane material, and is contacted to the photosensitive drum 51 with an urging force of about 35 g/cm as linear pressure. The regulating blade 55 removes a residual matter such as a transfer residual toner remaining on the surface of the photosensitive drum 51 after the discharge.

The memory 62 stores information on the photosensitive drum 51. The information on the photosensitive drum 51 includes at least one of information on a film thickness of the photosensitive drum 51, information on a cumulative rotation time of the photosensitive drum 51 and information on use hysteresis of the photosensitive drum 51.

The intermediary transfer unit 44 includes a plurality of rollers including a driving roller 44*a*, a follower roller 44*d* and the primary transfer rollers 47*y*, 47*m*, 47*c* and 47*k* and includes the intermediary transfer belt 44*b*, wound around these rollers, for carrying the toner images. The primary transfer rollers 47*y*, 47*m*, 47*c* and 47*k* are disposed opposed to the photosensitive drums 51*y*, 51*m*, 51*c* and 51*k*, respectively, and contact the intermediary transfer belt 44*b*.

By applying a positive transfer bias to the intermediary transfer belt 44*b* through the primary transfer rollers 47, negative toner images on the photosensitive drums 51 are multiple-transferred successively onto the intermediary transfer belt 44*b*.

The secondary transfer portion 45 includes an inner secondary transfer roller 45*a* and an outer secondary transfer roller 45*b*. By applying a positive secondary transfer bias to the outer secondary transfer roller 45*b*, the full-color toner image formed on the intermediary transfer belt 44*b* is transferred onto the sheet S.

The fixing portion 46 includes a fixing roller 46*a* and a pressing roller 46*b*. The sheet S is nipped and fed between the fixing roller 46*a* and the pressing roller 46*b*, whereby the toner image transferred on the sheet S is heated and pressed and is fixed on the sheet S. The sheet discharging portion feeds the sheet S fed along the discharging path after the fixing and, for example, discharges the sheet S through a discharge opening and stacks the sheet S on a discharge tray.

As shown in FIG. 3, the controller 11 is constituted by a computer and includes, for example, a CPU 71, a ROM 72 for storing a program for controlling the respective portions, a RAM 73 for temporarily storing data, and an input/output circuit (I/F) 74 through which signals are inputted from and outputted into an external device. The CPU 71 is a microprocessor for managing an entirety of control of the image forming apparatus 1 and is a main body of a system controller. The CPU 71 is connected with the sheet feeding portion, the image forming portion 40, the sheet discharging portion and the temperature and humidity sensor 12 via the input/output circuit 74 and not only transfers signals with the respective portions but also controls operations of the respective portions. In the ROM 72, an image forming control sequence for forming the image on the sheet, and the table (Table 2) showing a relationship between an injection current Idc and a correction amount of a charging voltage when the lateral stripe correction is carried out, and the like are stored.

With the controller 11, the charging bias voltage source 60, the current value measuring circuit 61 and the driving circuit 63 are connected. The controller 11 causes the charging bias voltage source 60 to output a DC voltage as a charging bias and to apply the charging bias to the charging bias 52 via the core metal 25, so that the surface of the photosensitive drum 51 is charge-controlled to a predetermined potential. The current value measuring circuit 61 detects the injection current Idc which flows from the charging roller 52 into the photosensitive drum 51 and which is injected into the photosensitive drum 51. The driving circuit 63 is a driver circuit of the motor 13 for rotating the photosensitive drum 51.

The controller 11 changes an image forming condition at the time of image formation in the case where a detected value by the current value measuring circuit 61 is out of a predetermined range when the charging bias is less than a voltage at which the discharge starts between the photosensitive drum 51 and the charging roller 52 during non-image formation. Further, the controller 11 causes the charging bias voltage source 60 to increase the charging bias, so that a potential difference at a downstream charging gap portion Gd between the photosensitive drum 51 and the charging roller 52 with respect to the rotational direction of the photosensitive drum 51 is increased. On the basis of the injection current Idc detected by the current value, the controller 11 calculates the injection current Idc flowing from the charging roller 52 into the photosensitive drum 51 when a target charging bias is applied to the charging roller 52 during the image formation. Further, the controller 11 changes the image forming condition during the image formation on the basis of the calculated injection current Idc.

Herein, during the image formation refers to a period in which the toner image is formed on the photosensitive drum 51 on the basis of the image information inputted from a scanner provided to the image forming apparatus 1 or an external terminal such as a personal computer. Further, during the non-image formation refers to a period, other than during the image formation, such as during pre-rotation, during a sheet interval, during post-rotation in an image forming job or a period in which the image forming job is not carried out.

Next, the image forming operation of the image forming apparatus 1 constituted as described above will be described.

When the image forming operation is started, first, the photosensitive drum 51 is rotated and the surface thereof is electrically charged by the charging roller 52. Then, on the basis of the image information, the laser light is emitted from the exposure device 42 to the photosensitive drum 51, so that the electrostatic latent image is formed on the surface of the photosensitive drum 51. The toner is deposited on this electrostatic latent image, whereby the electrostatic latent image is developed and visualized as the toner image and then the toner image is transferred onto the intermediary transfer belt 44*b*.

On the other hand, the sheet S is fed in parallel to such a toner image forming operation, and is conveyed to the secondary transfer portion 45 along the feeding path by being timed to the toner image on the intermediary transfer belt 44*b*. Then, the image is transferred from the intermediary transfer belt 44*b* onto the sheet S. The sheet S is conveyed to the fixing portion 46, in which the unfixed toner image is heated and pressed and thus is fixed on the surface of the sheet S, and then the sheet S is discharged from the apparatus main assembly 10.

A mechanism of generation of a lateral stripe will be specifically described.

As shown in FIG. 2, by rotation of the photosensitive drum 51, the charging roller 52 is rotated in a normal direction and charges the photosensitive drum 51. At an upstream charging gap portion Gu, when the potential difference between the photosensitive drum 51 and the charging roller 52 exceeds the discharge start voltage Vth (based on the Paschen's law), the discharge is caused, so that the photosensitive drum 51 is charged to the surface potential Vd. However, when a resistance of a part of the charging roller 52 is high, the charging is not uniformly completed at the upstream charging gap portion Gu in some cases. At that time, minute discharge generates at the downstream charging gap portion Gd, and therefore a charging lateral stripe generates.

For that reason, in order to prevent the charging lateral stripe, it is desired that:

(1) At the downstream charging gap portion Gd, the minute discharge is prevented from generating, or (2) At the downstream charging gap portion Gd, continuous stable discharge is generated.

Here, the potential difference between the photosensitive drum 51 and the charging roller 52 at the downstream charging gap portion Gd is referred to as a downstream discharge potential difference Vgap. Then, in order to prevent the charging lateral stripe, the above methods (1) and (2) are replaced with:

(1) The downstream discharge potential difference Vgap equals to the discharge start voltage Vth (Vgap=Vth), or (2) The downstream discharge potential difference Vgap is sufficiently larger than the discharge start voltage Vth.

Figure 4:
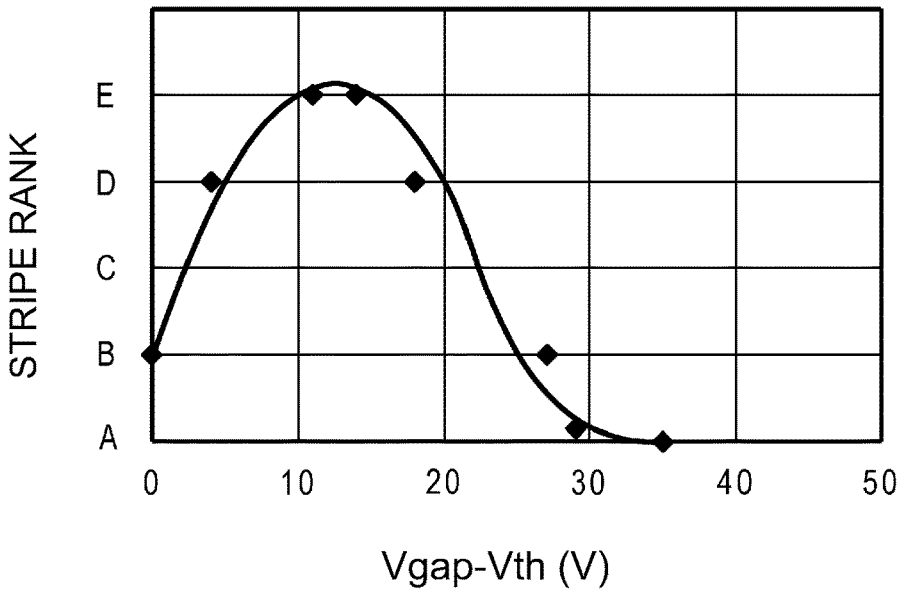
In FIG. 4, (a) is a graph showing a relationship between a potential difference at a downstream charging gap portion and a lateral stripe rank in the image forming apparatus in First Embodiment, and (b) is a graph showing a relationship between an injection current and a potential increase value of the photosensitive drum in the image forming apparatus in First Embodiment.
Figure 4:
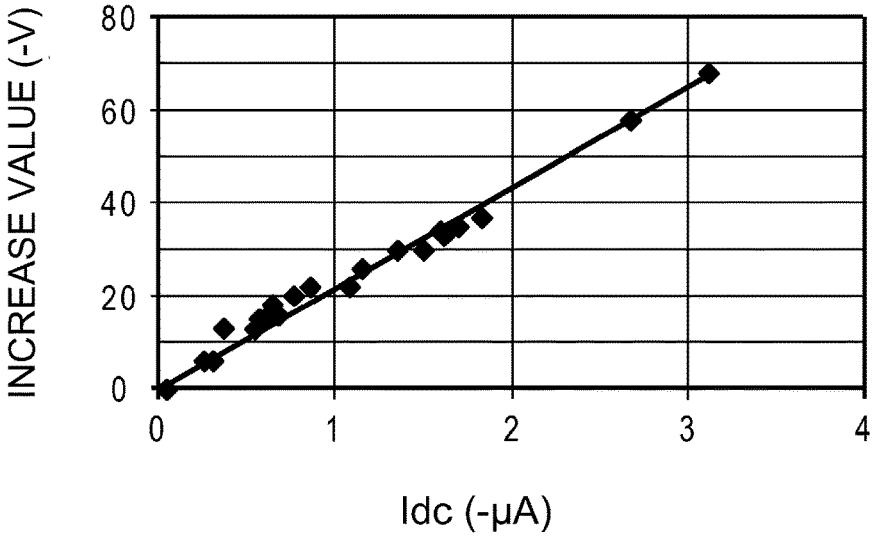

Specifically, as shown in (a) of FIG. 4, there is a correlation between (Vgap-Vth) and a lateral stripe rank (A: good to E: poor), and in this embodiment, at (Vgap-Vth)=15 V, the lateral stripe rank is worst. This is because at about (Vgap-Vth)=15 V, improper charging due to the minute discharge generates but at about (Vgap-Vth)=0 V, the discharge at the downstream charging gap portion Gd does not generate and therefore the lateral stripe rank is good. Further, in a region of (Vgap-Vth)>30 V, stable discharge generates and therefore the improper charging does not generate, so that the lateral stripe rank is good. In this embodiment, for image evaluation for setting the lateral stripe rank, a sheet on which a halftone image (125 in 255 gradation levels) was formed in an entire area was used.

However, in the above-described method (1) in which the downstream discharge potential difference Vgap is made equal to the discharge start voltage Vth, at the upstream charging gap portion Gu, there is a need that the charging is uniformly completed. However, it is difficult to make the potential difference Vgap at the downstream charging gap portion Gd equal to the discharge start voltage Vth due to charging non-uniformity resulting from resistance non-uniformity of the charging roller 52, and a lowering in surface potential resulting from dark decay of the photosensitive drum 51. On the other hand, the above-described method (2) in which the potential difference at the downstream charging gap portion Gd is made sufficiently larger than the discharge start voltage Vth can be realized by suppressing a discharge amount at the upstream charging gap portion Gu and by increasing a dark-decay amount of the photosensitive drum 51 at the nip. In the case of the method (2), a level of the lateral stripe worsens in a high temperature/high humidity environment. This is because in the high temperature/high humidity environment, a discharging property (charging performance) of the charging roller 52 is good and the photosensitive drum 51 is sufficiently charged at the upstream charging gap portion Gu, and thus the downstream discharge potential difference Vgap cannot be made large. In the constitution including the photosensitive drum 51 and the charging roller 52 in this embodiment, these members providing an initial (Vgap-Vth) of 30 V were used.

Next, charge injection will be described. Even in the case of a lowering in electric resistance of the surface of the photosensitive drum 51 at a level such that it does not cause the image flow, at a contact portion of the charging roller 52 with the photosensitive drum 51, electric charges are directly injected into the photosensitive drum 51 (hereinafter referred to as (electric) charge injection), so that an increase in surface potential Vd of the photosensitive drum 51 generates. In the constitution of the AC+DC charging, even when the increase in surface potential Vd of the photosensitive drum 51 is generated by the charge injection at the contact portion, the increase in surface potential Vd is canceled by the AC charging (positive and negative in a side downstream of the contact portion). However, in the constitution of the DC charging, the positive-side discharge did not sufficiently generate at the downstream charging gap portion Gd, so that there was a liability that the influence of the increase in surface potential Vd due to the charge injection was left as it is.

For this reason, in the image forming apparatus 1 employing the contact DC charging type, in the constitution in which the generation of the charging lateral stripe is suppressed by forming a sufficient downstream discharge potential difference Vgap at the downstream charging gap portion Gd, the following problem arose. That is, when the potential increase is generated by the charge injection in the nip, the downstream discharge potential difference Vgap necessary to suppress the lateral stripe generation cannot be ensured, so that there was a problem that there is a liability that the lateral stripe level worsens due to generation of the peeling discharge. Particularly, in the high temperature/high humidity environment, a charge injection amount was large, and therefore the lateral stripe was liable to generate.

Next, measurement of the charge injection amount will be described. In this embodiment, a DC voltage less than the discharge start voltage Vth is applied to the charging roller 52 with an injection current Idc which is a direct current at that time, and when Idc is zero, image formation is started. When Idc is not zero, the potential increase value of the photosensitive drum 51 during image formation by the charge injection is calculated, and depending on the potential increase value, control of the lateral stripe prevention described later is carried out.

The direct current due to the charge injection (hereinafter referred to as the injection current) is represented by a difference between a direct current when the DC voltage is applied to the photosensitive drum 51 into which the charge injection generates and a direct current when the DC voltage is applied to the photosensitive drum 51 into which the charge injection does not generate. The applied voltage and the injection current roughly provide a linear relationship, and therefore, from a value of the injection current when the DC voltage in an undischarged region is applied, it is possible to calculate the injection current at the applied voltage during image formation. This calculation can be represented by a formula 1 below when the injection current at an applied voltage V1 during non-image formation is Idc1, the injection current at an applied voltage V2 during non-image formation is Idc2, and the injection current intended to be acquired at an applied voltage V during image formation is Idc.

$$Idc = \frac{Idc2 - Idc1}{V2 - V1} \times V \qquad \text{(formula 1)}$$

In this embodiment, a value of the injection current at the applied voltage V during image formation is acquired from a rectilinear line obtained from the injection current Idc1 when the DC voltage of −300 V is applied to the charging roller 52 and the injection current Idc2 when the DC voltage of −500 V is applied to the charging roller 52. For example, it is assumed that the injection current Idc1 at the applied voltage V1=−300 V is −0.12 μA and the injection current Idc2 at the applied voltage V2=−500 V is −0.34 μA. In this case, the injection current Idc at the applied voltage V=−1100 V is, from the formula 1, (−0.34−(−0.12))/(−500−(−300))×(−1100)=−1.21 μA.

Here, as shown in (b) of FIG. 4, there is a correlation between the injection current and the potential increase value of the photosensitive drum 51, and therefore, from the value of the injection current, it is possible to acquire the potential increase value during image formation at the nip between the photosensitive drum 51 and the charging roller 52. As regards calculation of the potential increase value in this case, when a thickness of the surface layer of the photosensitive drum 51 is d (m), a dielectric constant of the photosensitive drum 51 is ∈ (F/m), a process speed of the photosensitive drum 51 is p (m/s), and a width of the charging roller 52 is w (m), the potential increase value is represented by a formula 2 below. This formula 2 is derived from a relational expression among the potential, the electric charge and electrostatic capacity.

$$V = \frac{p \cdot d}{\varepsilon \cdot w} \times Idc \qquad \text{(formula 2)}$$

Next, a relationship between the lateral stripe and the charge injection amount will be described. In this embodiment, the photosensitive drum 51 and the charging roller 52 which provide (Vgap-Vth)=30 V are used. For that reason, from the relationship between the injection current and the potential increase value of the photosensitive drum 51 shown in (b) of FIG. 4 and the relationship between (Vgap-Vth) and the lateral stripe rank shown in (a) of FIG. 4, as regards the injection current Idc and the charging lateral stripe rank, a relationship shown in Table 1 below is satisfied. As shown in Table 1, with an increase in injection current Idc, the lateral stripe rank worsens. In this embodiment, in image evaluation, charging application and image formation were carried out in a high temperature/high humidity environment of 30° C. in temperature and 80% RH in relative humidity.

TABLE 1

| | | | | | |
|---|---|---|---|---|---|
| IC*1 Idc(−μA) | 0.00 | 0.24 | 0.53 | 0.71 | 1.09 |
| PIV*2 (−V) | 0 | 6 | 10 | 14 | 18 |
| LSR*3 | A | B | D | E | E |

*1"IC" is the injection current.
*2"PIV" is the potential increase value.
*3"LSR" is the lateral stripe rank.

Here, a countermeasure against the lateral stripe generation will be described. As shown in Table 1, there is a correlation between the injection current Idc and the lateral stripe rank, and therefore, depending on an increment of the injection current Idc, there is a need to increase the downstream discharge potential difference Vgap. In this embodiment, the potential increase value increases with the increase in injection current Idc, and on the other hand, the generation of the lateral stripe is suppressed by increasing the surface potential Vd of the photosensitive drum 51. Specifically, as regards an initial setting of the surface potential Vd of −500 on the photosensitive drum 51 (i.e., the applied voltage to the charging roller 52 is −1100 V), the surface potential Vd was increased by −50 V every increase in potential increase value by −5 V due to the increase in injection current Idc by 0.25 μA. As a result, the lateral stripe rank after correction of the surface potential Vd was as shown in Table 2 below. As shown in Table 2, the lateral stripe rank was largely improved by the correction of the surface potential Vd. In Table 2, the lateral stripe rank before the correction is a lateral stripe rank in the high temperature/high humidity environment of 30° C. in temperature and 80% RH in relative humidity, but the lateral stripe rank after the correction is a lateral stripe rank as a result of uniformly making the correction irrespective of the temperature and the humidity.

TABLE 2

| | | | | | |
|---|---|---|---|---|---|
| IC*1 Idc(−μA) | 0.00 | 0.24 | 0.53 | 0.71 | 1.09 |
| LSRBC*2 | A | B | D | E | E |
| CVCA*3 | 0 | 50 | 100 | 150 | 200 |
| LSRAC*4 | A | A | A | B | B |

*1"IC" is the injection current.
*2"LSRBC" is the lateral stripe rank before the correction.
*3"CVCA" is the charging voltage correction amount.
*4"LSRAC" is the lateral stripe rank after the correction.

As a reason for improvement in lateral stripe rank, by increasing the set value of the surface potential Vd, it is possible to cite two reasons consisting of (1) insufficient charging at the upstream charging gap portion Gu and (2) increase in short-period dark-decay amount of the photosensitive drum 51. For these two reasons, the downstream discharge potential difference Vgap increased, so that the lateral stripe generation was suppressed. In order to maintain an image constant, depending on an increase amount of the surface potential Vd of the photosensitive drum 51, the developing DC bias applied to the developing device 53 and an exposure output of the exposure device 42 are adjusted. Further, in the case where a set value of the surface potential Vd of the photosensitive drum 51 is Vd=−700 V from an initial stage, there is a possibility that abrasion of the photosensitive drum 51 and the charging roller 52 are accelerated due to the increase in discharge current amount and thus a lifetime is shortened. For that reason, depending on a level of the injection current Idc, the surface potential Vd of the photosensitive drum 51 may preferably be adjusted.

Figure 5:
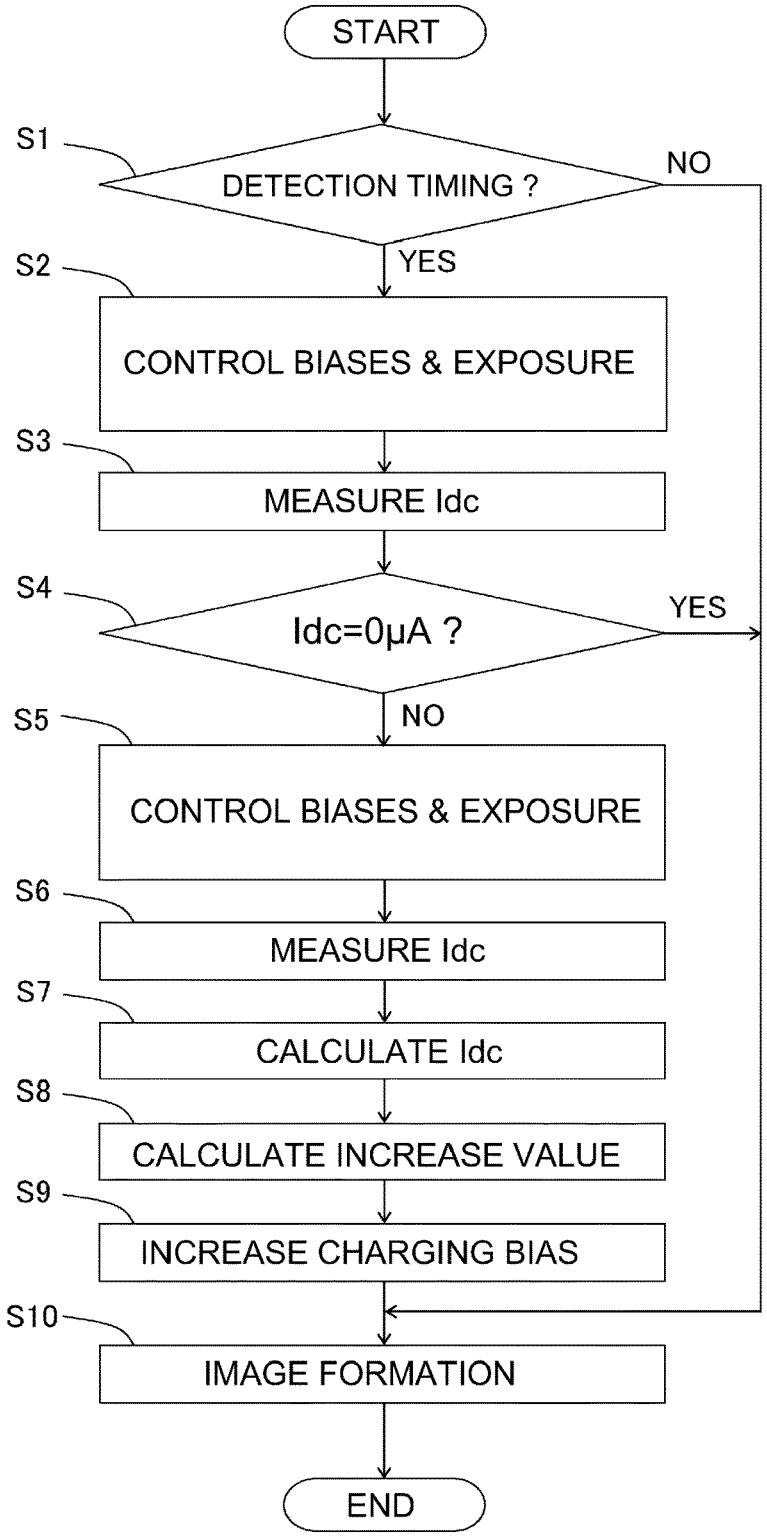
FIG. 5 is a flowchart showing a procedure when a charging bias is increased for suppressing lateral stripe generation in the image forming apparatus in First Embodiment.

Next, in the above-described image forming apparatus 1, a procedure of setting the potential of the photosensitive drum 51 during non-image formation before image formation in order to suppress the lateral stripe generation will be described with a flow chart shown in FIG. 5.

The controller 11 discriminates, during non-image formation such as pre-rotation or a sheet interval, whether or not timing is detection timing when detection of the lateral stripe rank is carried out (step S1). The controller 11 executes the detection of the lateral stripe rank depending on whether or not, for example, image formation is performed on a predetermined number of sheets. In the case where the controller 11 discriminated that the timing is not the detection timing, the controller 11 executes the image formation (step S10). In the case where the controller 11 discriminated that the timing is the detection timing, the controller 11 causes the photosensitive drum 51 to rotate and controls the respective biases and the exposure (step S2). In this step, the controller 11 causes the charging bias voltage source 60 to apply, to the charging roller 52, a DC voltage less than the discharge start voltage Vth, e.g., the DC voltage of −500 V. Further, the controller 11 turns on the pre-exposure device 54, turns off the exposure device 42 and turns off the developing bias and the transfer bias.

The controller 11 causes the current value measuring circuit 61 to measure the injection current Idc injected from the charging roller 52 into the photosensitive drum 51 under application of the charging bias (step S3). In this step, as regards the photosensitive drum 51 into which the charge injection is capable of generating, even in the case where the DC voltage less than the discharge start voltage Vth is applied, the current injected from the charging roller 52 into the photosensitive drum 51 is detected as the injection current Idc by the current value measuring circuit 61. The controller 11 discriminates whether or not the injection current Idc measured by the current value measuring circuit 61 is 0 μA (step S4).

In the case where the controller 11 discriminated that the injection current Idc was 0 μA, the controller 11 discriminates that the charge injection into the photosensitive drum 51 does not generate and that the lateral stripe rank is good, and thus executes the image formation (step S10). In the case where the controller 11 discriminated that the injection current Idc was not 0 μA, the controller 11 controls the respective biases and the exposure in a state in which the photosensitive drum 51 is rotated again (step S5). In this step, the controller 11 causes the charging bias voltage source 60 to apply, to the charging roller 52, the DC voltage which is less than the discharge start voltage Vth and which is, e.g., −300 V different from the DC voltage in the step S2. Further, the controller 11 turns on the pre-exposure device 54, turns off the exposure device 42 and turns off the developing bias and the transfer bias. The controller 11 causes the current value measuring circuit 61 to measure the injection current Idc injected from the charging roller 52 into the photosensitive drum 51 under application of the charging bias (step S6).

On the basis of the two injection currents Idc detected in the steps S3 and S6, the controller 11 calculates, by using, e.g., the above-described formula 1, the injection current Idc flowing into the photosensitive drum 51 when a target charging bias is applied to the charging roller 52 during image formation (step S7). Then, on the basis of, e.g., the above-described formula 2, the controller 11 calculates the potential increase value of the photosensitive drum 1 during image formation by using the injection current Idc acquired by the formula 1 (step S8). Then, the controller 11 increases and applies the charging bias so that, e.g., as shown in Table 2, the surface potential Vd of the photosensitive drum 51 increases with the increase in potential increase value due to the increase in acquired injection current Idc (step S9), and then executes the image formation (step S10). That is, the controller 11 sets an increase amount of the charging bias on the basis of the potential increase value of the photosensitive drum 51 during image formation.

In this embodiment, the controller 11 sets the increase amount of the charging bias on the basis of the potential increase value of the photosensitive drum 51 during image formation, but the present invention is not limited thereto. For example, the increase amount of the charging bias may also be set by calculation or by making reference to a table on the basis of the injection current Idc without calculating the potential increase value.

As described above, according to this embodiment, the controller 11 carries out the control in the following manner when the charging bias is less than the voltage at which the discharge starts between the photosensitive drum 51 and the charging roller 52 during non-image formation. At that time, in the case where the detected value by the current value measuring circuit 61 is out of a predetermined range, the controller 11 changes the image forming condition. For this reason, the controller 11 makes setting in the following manner in the case where the direct current injected from the photosensitive drum 51 into the charging roller 52 is detected under application of the charging bias although the charging bias is less than the voltage at which the discharge starts between the photosensitive drum 51 and the charging roller 52. In this case, depending on the injection current Idc, the controller 11 sets the image forming apparatus capable of suppressing the lateral stripe. As a result, the generation of the charging lateral stripe can be suppressed without shortening lifetimes of the photosensitive drum 51 and the charging roller 52 and without increasing electric power consumption.

Further, according to the image forming apparatus 1 in this embodiment, the controller 11 causes the charging bias voltage source 60 to increase the charging bias, so that the potential difference between the photosensitive drum 51 and the charging roller 52 at the downstream charging gap portion Gd with respect to the rotational direction of the photosensitive drum 51 is increased. For this reason, the controller 11 is capable of suppressing the generation of the charging lateral stripe without shortening the lifetimes of the photosensitive drum 51 and the charging roller 52 and without increasing the electric power consumption by a simple method such that the charging bias is increased by the charging bias voltage source 60.

In the above-described image forming apparatus 1 in this embodiment, the charging voltage correction amount was determined on the basis of the charging lateral stripe rank in the high temperature/high humidity environment of 30° C. in temperature and 80% in relative humidity and the correction was made uniformly irrespective of the temperature and the humidity, but the present invention is not limited thereto. For example, the controller 11 may also control the potential difference at the downstream charging gap portion Gd on the basis of the detected environment information. That is, even in the case where the injection current Idc is the same, the charging performance of the charging roller 52 and the dark-decay amount of the photosensitive drum 51 are different depending on the temperature and the humidity, and therefore, the correction amount may also be adjusted every temperature and every humidity. Particularly, in a low temperature/low humidity environment, the charging performance lowers and the discharge amount of the upstream charging gap portion Gu becomes smaller, and therefore, the low temperature/low humidity environment is advantageous for suppression of the charging lateral stripe, so that the charging voltage correction amount may also be small.

Second Embodiment

Figure 6:
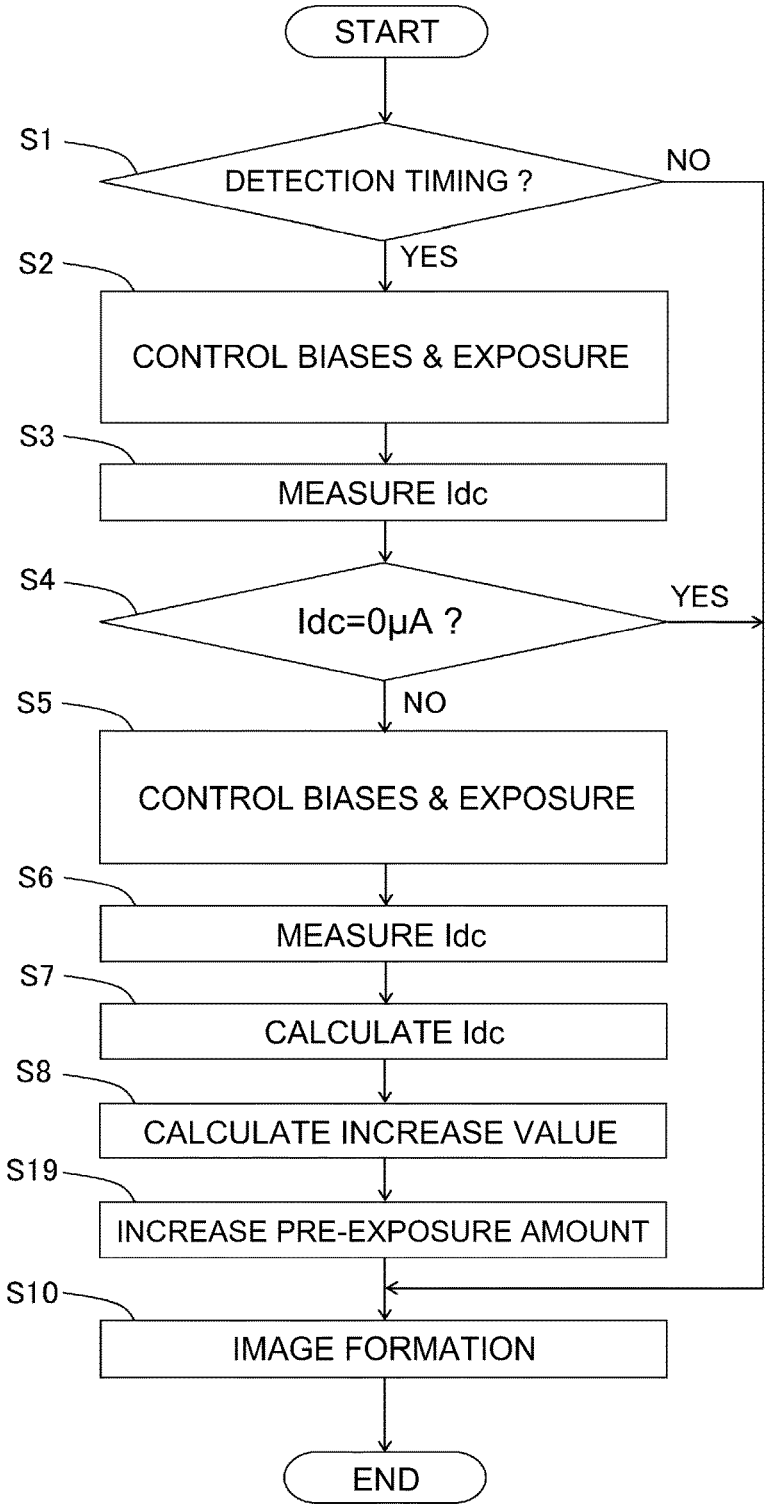
FIG. 6 is a flowchart showing a procedure when a pre-exposure amount is increased for suppressing lateral stripe generation in an image forming apparatus according to Second Embodiment.

Second Embodiment of the present invention will be specifically described with reference to FIG. 6. In this embodiment, the controller 11 causes the pre-exposure device 54 to increase an exposure amount in order to increase the surface potential Vd of the photosensitive drum 51 with, e.g., an increase in injection current Idc during image formation acquired by calculation from a detected value. Second Embodiment is different in constitution from First Embodiment in the above-described point, but other constitutions and control and the like are similar to those in First Embodiment, and therefore, represented by the same reference numerals or symbols and will be omitted from detailed description.

In this embodiment, the controller 11 increases the exposure amount (discharge amount) of the pre-exposure device 54 and thus increases the potential difference between the photosensitive drum 51 and the charging roller 52 at the downstream charging gap portion Gd with respect to the rotational direction of the photosensitive drum 51. Further, in the ROM 72, a table (Table 3 below) or the like showing a relationship between the injection current Idc and a correction amount of a pre-exposure amount when correction of preventing the lateral stripe is made is stored.

In this embodiment, the pre-exposure amount of the pre-exposure device (discharging means) 54 is increased with an increase in injection current Idc. Specifically, in this embodiment, with respect to an initial light quantity L=10 μW of the pre-exposure device 54, the light quantity was increased every increase in injection current Idc by 0.25 μA. As a result, the lateral stripe rank after correction of the surface potential Vd was as shown in Table 3 below. As shown in Table 3, the lateral stripe rank was largely improved by the correction of the pre-exposure amount. In Table 3, the lateral stripe rank before the correction is a lateral stripe rank in the high temperature/high humidity environment of 30° C. in temperature and 80% RH in relative humidity, but the lateral stripe rank after the correction is a lateral stripe rank as a result of uniformly making the correction irrespective of the temperature and the humidity.

TABLE 3

| | | | | | |
|---|---|---|---|---|---|
| IC*1 Idc(−μA) | 0.00 | 0.24 | 0.53 | 0.71 | 1.09 |
| LSRBC*2 | A | B | D | E | E |
| PEAIA*3 | 0 | 8 | 16 | 24 | 32 |
| LSRAC*4 | A | A | B | B | C |

*1"IC" is the injection current.
*2"LSRBC" is the lateral stripe rank before the correction.
*3"PEAIA" is the pre-exposure amount increase amount.
*4"LSRAC" is the lateral stripe rank after the correction.

As a reason for improvement in lateral stripe rank, by increasing the pre-exposure amount, it is possible to achieve the following two functions consisting of (1) insufficient charging at the upstream side by lowering the surface potential Vd of the photosensitive drum 51 in front of the upstream charging gap portion Gu and (2) increase in dark-decay amount by increasing a remaining amount of photo-carriers in the photosensitive drum 51. By these two functions, the downstream discharge potential difference Vgap was increased, so that the lateral stripe generation was suppressed. Further, in the case where an initial light quantity L of the pre-exposure device 54 is L=32 μW from an initial stage, there is a possibility that abrasion of the photosensitive drum 51 and the charging roller 52 are accelerated due to the increase in discharge current amount and thus a lifetime is shortened. For that reason, depending on a level of the charge injection, the pre-exposure amount may preferably be adjusted.

Next, in the above-described image forming apparatus 1, a procedure of setting the pre-exposure amount during non-image formation before image formation in order to suppress the lateral stripe generation will be described with a flow chart shown in FIG. 6. In FIG. 6, steps S1 to S8 and S10 are similar to those in First Embodiment and therefore will be omitted from detailed description.

In this embodiment, in the case where the two injection currents Idc are measured in steps S3 and S6, on the basis of the two injection currents Idc, the controller 11 calculates the injection current Idc during image formation by using, e.g., the above-described formula 1 (step S7). Then, on the basis of, e.g., the above-described formula 2, the controller 11 calculates the potential increase value of the photosensitive drum 1 during image formation by using the injection current Idc acquired by the formula 1 (step S8). Then, the controller 11 increases the pre-exposure amount so that, e.g., as shown in Table 3, the pre-exposure amount increases with the increase in potential increase value due to the increase in acquired injection current Idc, and effects the exposure with the increased pre-exposure amount (step S19), and then executes the image formation (step S10). In this embodiment, the controller 11 sets the increase amount of the pre-exposure amount on the basis of the potential increase value of the photosensitive drum 51 during image formation, but the present invention is not limited thereto. For example, the increase amount of the pre-exposure amount may also be set by calculation or by making reference to a table on the basis of the injection current Idc without calculating the potential increase value.

As described above, also according to this embodiment, the controller 11 carries out the control in the following manner when the charging bias is less than the voltage at which the discharge starts between the photosensitive drum 51 and the charging roller 52 during non-image formation. In the case where the detected value by the current value measuring circuit 61 is out of a predetermined range, depending on the injection current Idc, the controller 11 sets the image forming apparatus capable of suppressing the lateral stripe. As a result, the generation of the charging lateral stripe can be suppressed without shortening lifetimes of the photosensitive drum 51 and the charging roller 52 and without increasing electric power consumption.

Further, according to the image forming apparatus 1 in this embodiment, the controller 11 causes the pre-exposure device 54 to increase the pre-exposure amount, so that the potential difference between the photosensitive drum 51 and the charging roller 52 at the downstream charging gap portion Gd with respect to the rotational direction of the photosensitive drum 51 is increased. For this reason, the controller 11 is capable of suppressing the generation of the charging lateral stripe without shortening the lifetimes of the photosensitive drum 51 and the charging roller 52 and without increasing the electric power consumption by a simple method such that the process speed amount of the pre-exposure device 54 is increased.

In the above-described image forming apparatus 1 in this embodiment, the pre-exposure amount correction amount was determined on the basis of the charging lateral stripe rank in the high temperature/high humidity environment of 30° C. in temperature and 80% in relative humidity and the correction was made uniformly irrespective of the temperature and the humidity, but the present invention is not limited thereto. For example, even in the case where the injection current Idc is the same, the charging performance of the charging roller 52 and the dark-decay amount of the photosensitive drum 51 are different depending on the temperature and the humidity, and therefore, the correction amount may also be adjusted every temperature and every humidity. Particularly, in a low temperature/low humidity environment, the charging performance lowers and the discharge amount of the upstream charging gap portion Gu becomes smaller, and therefore, the low temperature/low humidity environment is advantageous for suppression of the charging lateral stripe, so that the pre-exposure amount correction amount may also be small.

Third Embodiment

Figure 7:
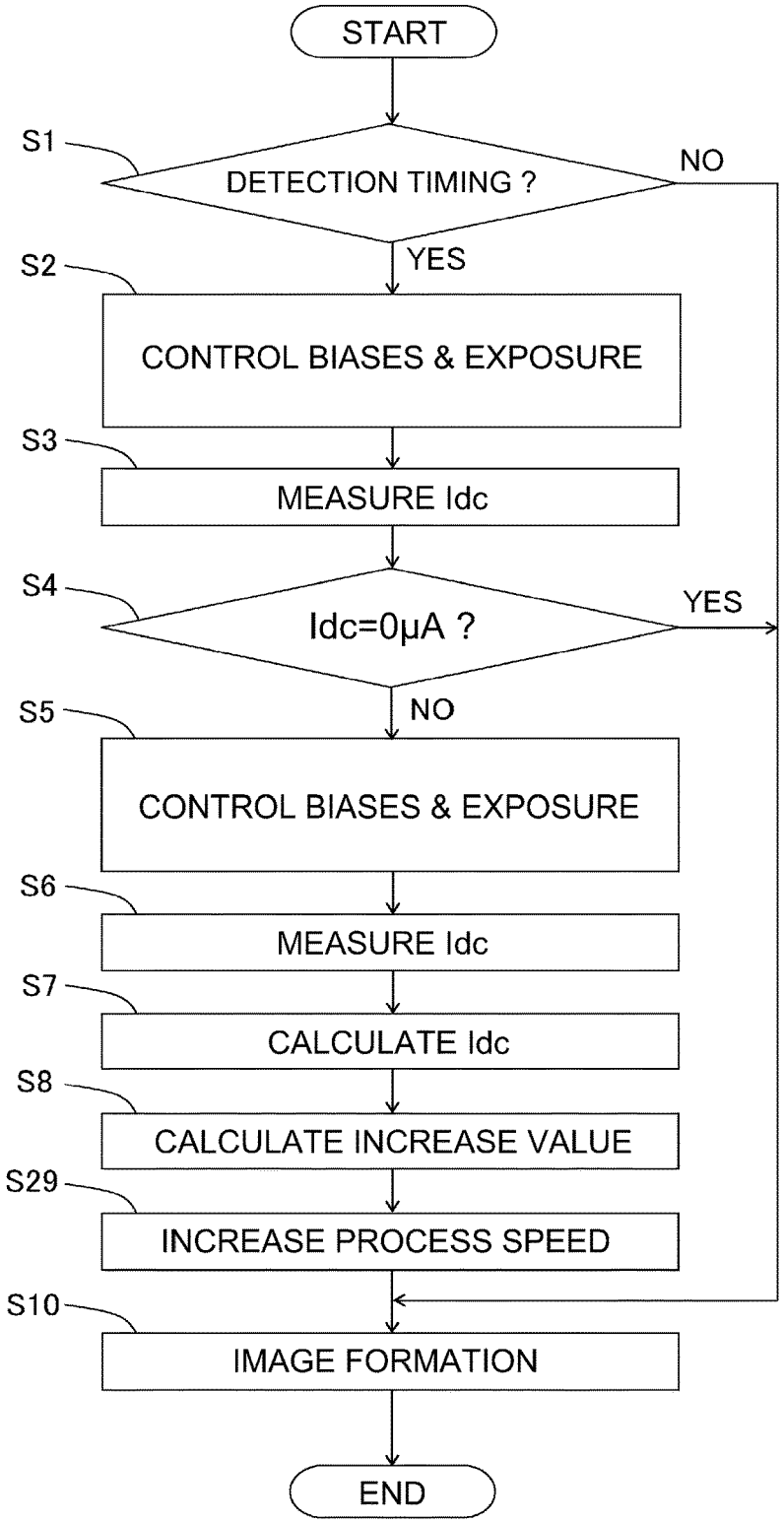
FIG. 7 is a flowchart showing a procedure when a process speed is increased for suppressing lateral stripe generation in an image forming apparatus according to Third Embodiment.

Third Embodiment of the present invention will be specifically described with reference to FIG. 7. In this embodiment, the controller 11 increases a process speed, which is a rotational speed, with, e.g., an increase in injection current Idc during image formation acquired by calculation from a detected value. Third Embodiment is different in constitution from First Embodiment in the above-described point, but other constitutions and control and the like are similar to those in First Embodiment, and therefore, represented by the same reference numerals or symbols and will be omitted from detailed description.

In this embodiment, the controller 11 increases the rotational speed of the photosensitive drum 51 by the motor (driving means) 13 and thus increases the potential difference between the photosensitive drum 51 and the charging roller 52 at the downstream charging gap portion Gd. Further, in the ROM 72, a table (Table 4 below) or the like showing a relationship between the injection current Idc and a correction amount of the process speed when correction of preventing the lateral stripe is made is stored.

In this embodiment, the process speed is increased with an increase in injection current Idc. Specifically, in this embodiment, with respect to the process speed of 210 mm/s, the process speed was increased every increase in injection current Idc by 0.25 μA. As a result, the lateral stripe rank after correction of the process speed was as shown in Table 4 below. As shown in Table 4, the lateral stripe rank was largely improved by the correction of the process speed. In Table 4, in the image forming apparatus 1 used in this embodiment, an upper limit of the process speed was 270 mm/s, and therefore the increase in process speed was carried out under a condition of the injection current Idc=−0.24 μA, −0.53 μA. Further, in Table 4, the lateral stripe rank before the correction is a lateral stripe rank in the high temperature/high humidity environment of 30° C. in temperature and 80% RH in relative humidity, but the lateral stripe rank after the correction is a lateral stripe rank as a result of uniformly making the correction irrespective of the temperature and the humidity.

TABLE 4

| | | | |
|---|---|---|---|
| IC*1 Idc(−μA) | 0.00 | 0.24 | 0.53 |
| LSRBC*2 | A | B | D |
| PSIA*3 | 0 | 26 | 52 |
| LSRAC*4 | A | A | B |

*1"IC" is the injection current.
*2"LSRBC" is the lateral stripe rank before the correction.
*3"PSIA" is the process speed increase amount.
*4"LSRAC" is the lateral stripe rank after the correction.

As a reason for improvement in lateral stripe rank, by increasing the process speed, it is possible to achieve the following two functions consisting of (1) insufficient charging at the upstream side since a time required for passing through the upstream charging gap portion Gu is shortened, and (2) decrease in charge injection amount since a time required for passing through the contact portion between the photosensitive drum 51 and the charging roller 52 is shortened. By these two functions, the downstream discharge potential difference Vgap was increased, so that the lateral stripe generation was suppressed. Further, in the case where the process speed is 262 m/s from an initial stage, there is a need to increase the fixing temperature of the fixing portion 46 in order to compensate for the lowering in fixing performance due to the increase in sheet feeding speed and thus there is a possibility that the increase in electric power consumption and shortened lifetime of the fixing portion 46 are invited. For that reason, depending on a level of the charge injection, the process speed may preferably be adjusted.

Next, in the above-described image forming apparatus 1, a procedure of setting the process speed during non-image formation before image formation in order to suppress the lateral stripe generation will be described with a flow chart shown in FIG. 7. In FIG. 7, steps S1 to S8 and S10 are similar to those in First Embodiment and therefore will be omitted from detailed description.

In this embodiment, in the case where the two injection currents Idc are measured steps S3 and S6, on the basis of the two injection currents Idc, the controller 11 calculates the injection current Idc during image formation by using, e.g., the above-described formula 1 (step S7). Then, on the basis of, e.g., the above-described formula 2, the controller 11 calculates the potential increase value of the photosensitive drum 1 during image formation by using the injection current Idc acquired by the formula 1 (step S8). Then, the controller 11 increases the rotational speed of the motor 13 so that, e.g., as shown in Table 4, the process speed increases with the increase in potential increase value due to the increase in acquired injection current Idc (step S29), and then executes the image formation (step S10). In this embodiment, the controller 11 sets the increase amount of the process speed on the basis of the potential increase value of the photosensitive drum 51 during image formation, but the present invention is not limited thereto. For example, the increase amount of the process speed may also be set by calculation or by making reference to a table on the basis of the injection current Idc without calculating the potential increase value.

As described above, also according to this embodiment, the controller 11 carries out the control in the following manner when the charging bias is less than the voltage at which the discharge starts between the photosensitive drum 51 and the charging roller 52 during non-image formation. In the case where the detected value by the current value measuring circuit 61 is out of a predetermined range, depending on the injection current Idc, the controller 11 sets the image forming apparatus capable of suppressing the lateral stripe. As a result, the generation of the charging lateral stripe can be suppressed without shortening lifetimes of the photosensitive drum 51 and the charging roller 52 and without increasing electric power consumption.

Further, according to the image forming apparatus 1 in this embodiment, the potential difference between the photosensitive drum 51 and the charging roller 52 at the downstream charging gap portion Gd with respect to the rotational direction of the photosensitive drum 51 is increased by increasing the process speed of the photosensitive drum 51. For this reason, the controller 11 is capable of suppressing the generation of the charging lateral stripe without shortening the lifetimes of the photosensitive drum 51 and the charging roller 52 and without increasing the electric power consumption by a simple method such that the process speed is increased.

In the above-described image forming apparatus 1 in this embodiment, the process speed correction amount was determined on the basis of the charging lateral stripe rank in the high temperature/high humidity environment of 30° C. in temperature and 80% in relative humidity and the correction was made uniformly irrespective of the temperature and the humidity, but the present invention is not limited thereto. For example, even in the case where the injection current Idc is the same, the charging performance of the charging roller 52 and the dark-decay amount of the photosensitive drum 51 are different depending on the temperature and the humidity, and therefore, the correction amount may also be adjusted every temperature and every humidity. Particularly, in a low temperature/low humidity environment, the charging performance lowers and the discharge amount of the upstream charging gap portion Gu becomes smaller, and therefore, the low temperature/low humidity environment is advantageous for suppression of the charging lateral stripe, so that the process speed correction amount may also be small.

Fourth Embodiment

Fourth Embodiment of the present invention will be specifically described with reference to FIGS. 8-10. In this embodiment, the controller 11 increases an image exposure amount at a white background portion, on which the toner is not deposited during development, so that the surface potential Vd of the photosensitive drum 51 at the developing position does not largely change between before and after control. Fourth Embodiment is different in constitution from First Embodiment in the above-described point, but other constitutions and control and the like are similar to those in First Embodiment, and therefore, represented by the same reference numerals or symbols and will be omitted from detailed description.

In the image forming apparatus 1 in this embodiment, similarly as in First Embodiment, as control of countermeasure against the lateral stripe, the controller 11 applies, to the charging roller 52 during non-image formation, the DC voltage less than the voltage at which the discharge starts between the photosensitive drum 51 and the charging roller 52. Then, the controller 11 increases the surface potential Vd by increasing the applied voltage during image formation depending on the detected amount of the direct current. However, when the surface potential Vd increases, a fog potential difference (a difference between the surface potential Vd and the developing bias Vdc) at the white background portion increases, and therefore, minute flowing-out of the developer from the developing device 53 is liable to generate. Therefore, in the image forming apparatus 1 in this embodiment, the controller 11 increases the exposure amount of the exposure device 42 so that the surface potential Vd at the developing position does not change between before and after the control, whereby the image exposure amount at the white background portion on which the toner is not deposited during the development is increased. Further, in the ROM 72, a sequence for correcting the exposure amount of the exposure device 42 when the correction for the lateral stripe prevention is made is stored.

Here, the correction of the image exposure amount at the white background portion will be described. In (a) of FIG. 8, the case where the correction for the lateral stripe prevention is not made in First Embodiment is shown by an inverted triangular plot. In this case, an applied voltage Vpr to the charging roller 52 is −1100 V, and the drum potential is −500 V as the dark-portion potential in the case where an image signal is 0, and is −200 V as the light-portion potential in the case where the image signal is 255. In this case, exposure correction is not carried out. On the other hand, the case where the applied voltage Vpr is increased by 200 V (absolute value) as the correction for the lateral stripe prevention in First Embodiment is shown by a rectangular (square) plot. In this case, an applied voltage Vpr to the charging roller 52 is −1300 V, and the drum potential is increased to −700 V as the dark-portion potential in the case where an image signal is 0, and is increased to −250 V as the light-portion potential in the case where the image signal is 255. Also in this case, exposure correction is not carried out.

Figure 8:
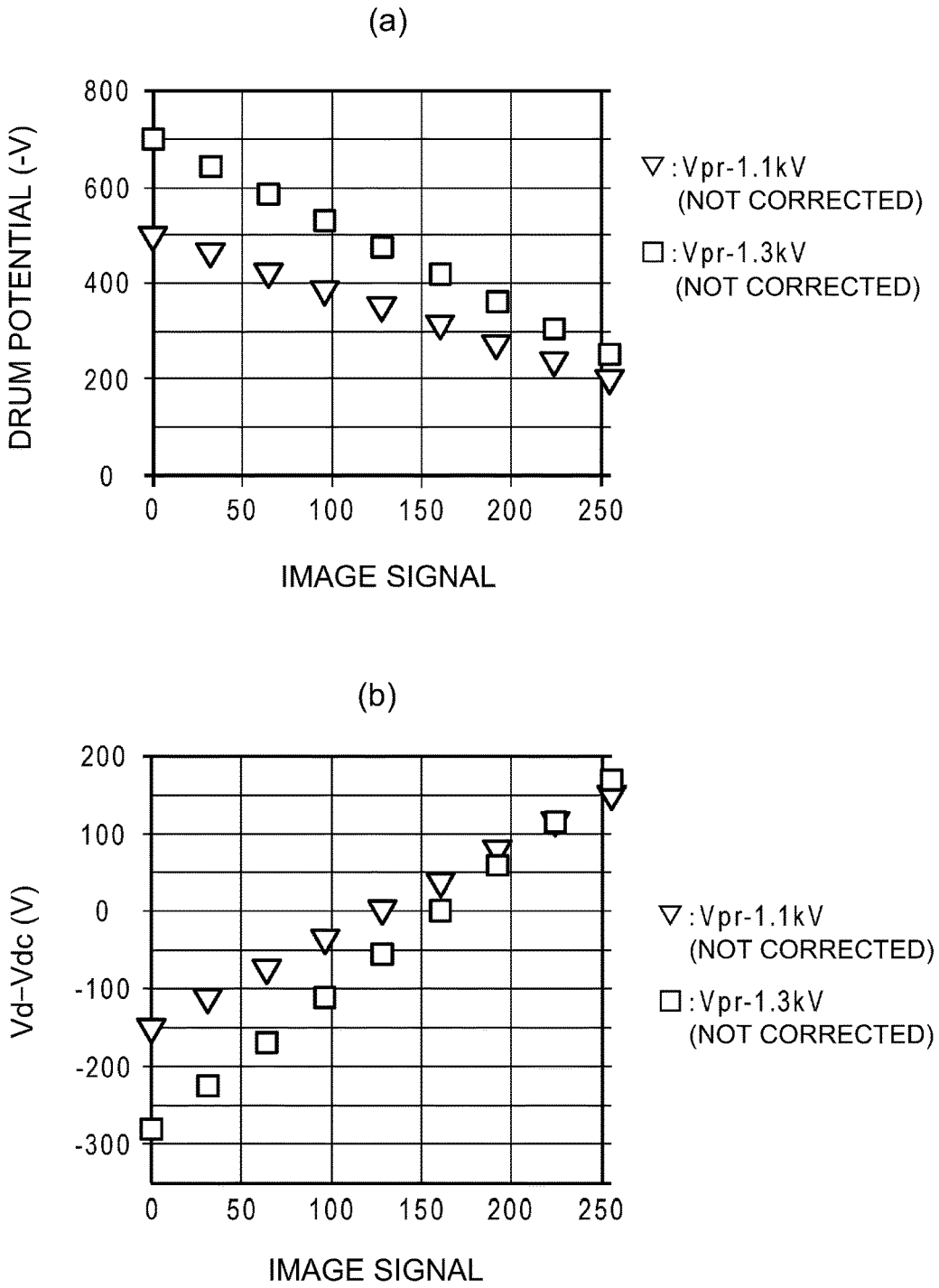
In FIG. 8, (a) is a graph showing a relationship between an image signal and a drum potential at a developing position in an image forming apparatus according to Fourth Embodiment, and (b) is a graph showing a relationship between the image signal and each of a developing contrast potential and a fog potential in the image forming apparatus in Fourth Embodiment.

In (b) of FIG. 8, the ordinate represents the difference between the surface potential (drum potential) Vd and the developing bias Vdc (Vd-Vdc), in which a positive direction represents a developing contrast potential and a negative side represents the fog potential. In the case the correction for the lateral stripe prevention is not carried out (the inverted triangular plot), when the developing bias applied to the developing device 53 is −550 V, the developing contrast potential is a difference between the light-portion potential of −200 V and the developing bias Vdc of −350 V, i.e., 150 V. In this case, the fog potential for suppressing a development fog was −150 V which is a difference between the dark-portion potential of −500 V and the developing bias Vdc of −350 V.

On the other hand, in the case where the applied voltage Vpr is increased by 200 V (the rectangular plot), the light-portion potential at the image signal of 255 is −250 V. For this reason, when an image density is intended to be made the same between the case where the lateral stripe correction is made and the case where the lateral stripe correction is not made, the developing bias Vdc is required to be −400 V. On the other hand, the dark-portion potential at the image signal of 0 when the applied voltage Vpr to the charging roller 52 is increased from −1.1 kV to −1.3 kV as the correction for the lateral stripe prevention is −700 V as described above. For this reason, the fog potential is −300 V which is a difference between the dark-portion potential of −700 V and the developing bias Vdc of −400 V. In general, a degree of the suppression of the fog is improved with an increasing fog potential, but the minute flowing-out of the developer such as the carrier increases, and therefore, some countermeasure may preferably be taken.

Figure 9:
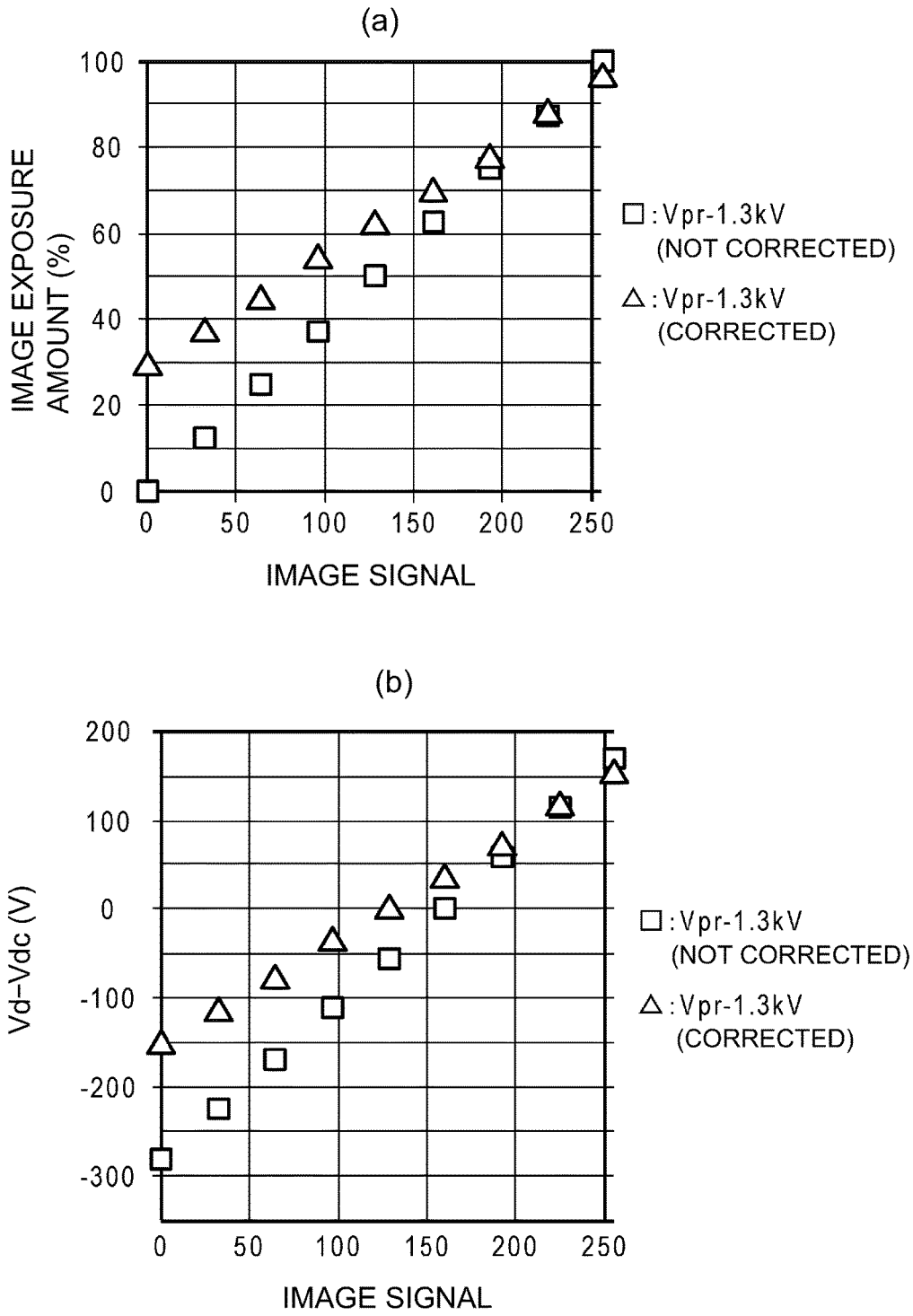
In FIG. 9, (a) is a graph showing a relationship between the image signal and an image exposure amount in the image forming apparatus in Fourth Embodiment, and (b) is a graph showing a relationship between the image signal and each of the developing contrast potential and the fog potential in the image forming apparatus in Fourth Embodiment.
Figure 10:
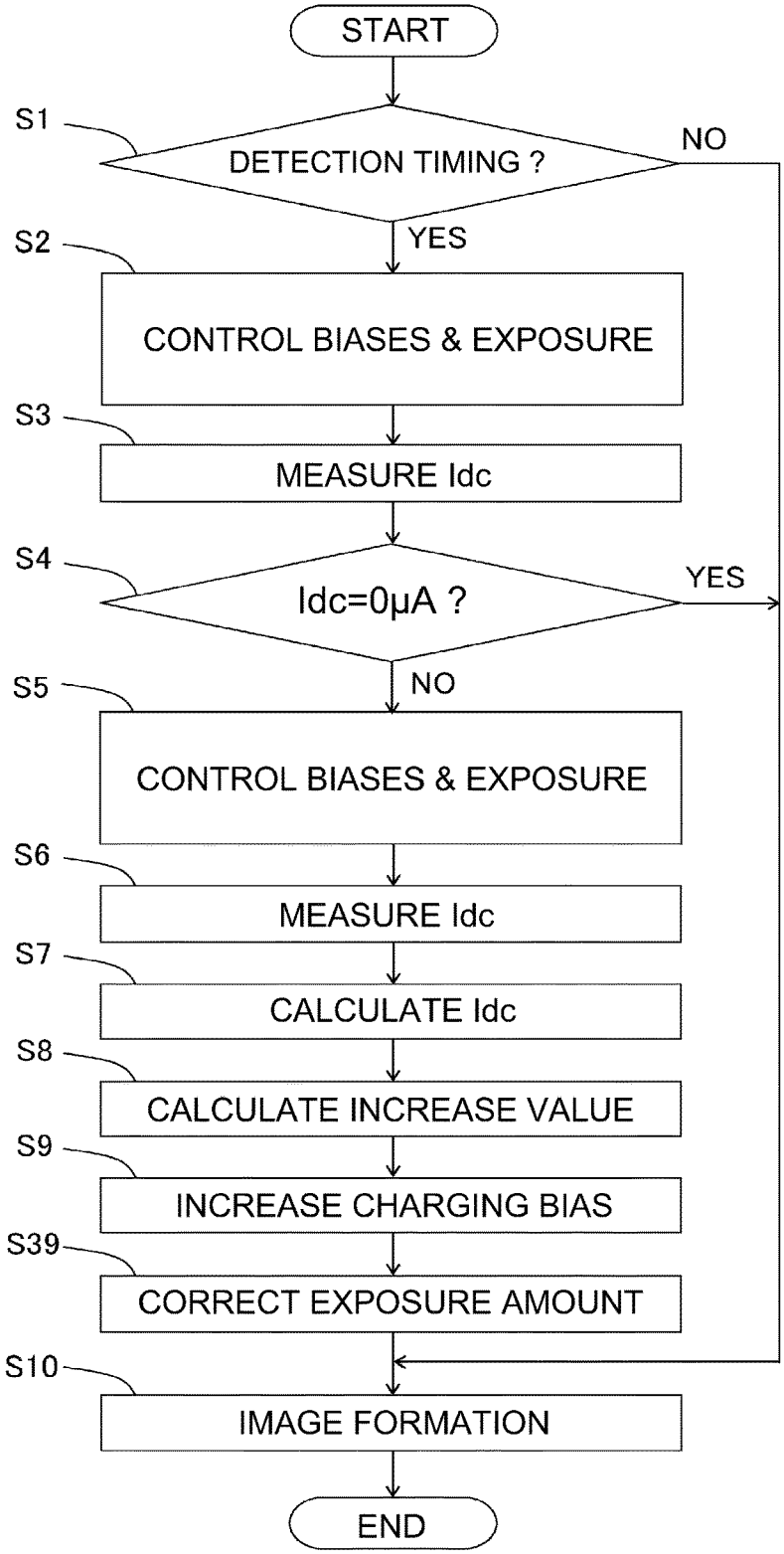
FIG. 10 is a flowchart showing a procedure when a charging bias is increased for suppressing lateral stripe generation in the image forming apparatus in Fourth Embodiment.

Therefore, in this embodiment, as shown in (a) of FIG. 9, with the correction for the lateral stripe prevention, an image exposure amount for the image signal is corrected, so that a degree of the change in surface potential Vd at the white background portion by the correction is minimized. As shown in (a) of FIG. 9, in the case where the applied voltage Vpr to the charging roller 52 is set at −1300 V and the exposure correction is not carried out (the rectangular plot), the image exposure amount at the image signal of 0 is 0%, i.e., zero emission of light, and the image exposure amount at the image signal of 255 is 100%. On the other hand, in the case where the applied voltage Vpr to the charging roller 52 is set at −1300 V and the exposure correction is carried out (the triangular plot), linear interpolation is performed between the image exposure amount of 30% at the image signal of 0 and the image exposure amount of 100% at the image signal of 255. Such a relationship between the image signal and the image exposure amount is stored as a calculation table in the ROM 72 of the image forming apparatus in the form of a plurality of table data, and these table data can be switched as desired.

Further, as shown in (b) of FIG. 9, in the case where the exposure correction is not carried out (the rectangular plot), the fog potential at the image signal of 0 is −300 V. On the other hand, in the case where the exposure correction is carried out (the triangular plot), the fog potential at the image signal of 0 is decreased to −150 V. That is, even at the fog potential portion which is the white background portion on the image, the surface potential Vd at the developing position is lowered by carrying out the image exposure, so that an excessive increase in fog potential can be prevented. As a result, it becomes possible to prevent the minute flowing-out of the developer from the developing device 53.

Next, in the above-described image forming apparatus 1, a procedure of setting the potential of the photosensitive drum 51 during non-image formation before image formation and of executing the exposure correction at the white background portion in order to suppress the lateral stripe generation will be described with a flow chart shown in FIG. 10. In FIG. 10, steps S1 to S9 and S10 are similar to those in First Embodiment and therefore will be omitted from detailed description.

In this embodiment, on the basis of, e.g., the above-described formula 2, the controller 11 calculates the potential increase value of the photosensitive drum 1 during image formation by using the injection current Idc acquired by the formula 1 (step S8). Then, the controller 11 increases the value and applies the charging bias so that, e.g., as shown in Table 2, the surface potential Vd of the photosensitive drum 51 increases in potential increase value due to the increase in acquired injection current Idc (step S9). Then, the controller 11 carries out the exposure correction at the white background portion (step S39), and then executes the image formation (step S10).

As described above, also according to this embodiment, the controller 11 carries out the control in the following manner when the charging bias is less than the voltage at which the discharge starts between the photosensitive drum 51 and the charging roller 52 during non-image formation. In the case where the detected value by the current value measuring circuit 61 is out of a predetermined range, depending on the injection current Idc, the controller 11 sets the image forming apparatus capable of suppressing the lateral stripe. As a result, the generation of the charging lateral stripe can be suppressed without shortening lifetimes of the photosensitive drum 51 and the charging roller 52 and without increasing electric power consumption.

Further, according to the image forming apparatus 1 in this embodiment, the controller 11 causes the charging bias voltage source 60 to increase the charging bias, so that the potential difference between the photosensitive drum 51 and the charging roller 52 at the downstream charging gap portion Gd with respect to the rotational direction of the photosensitive drum 51 is increased. Further, the controller 11 increases the image exposure amount at the white background portion so that the surface potential Vd at the developing position does not change between before and after the control. As a result, it becomes possible to prevent the minute flowing of the developer from the developing device 53.

Fifth Embodiment

Figure 11:
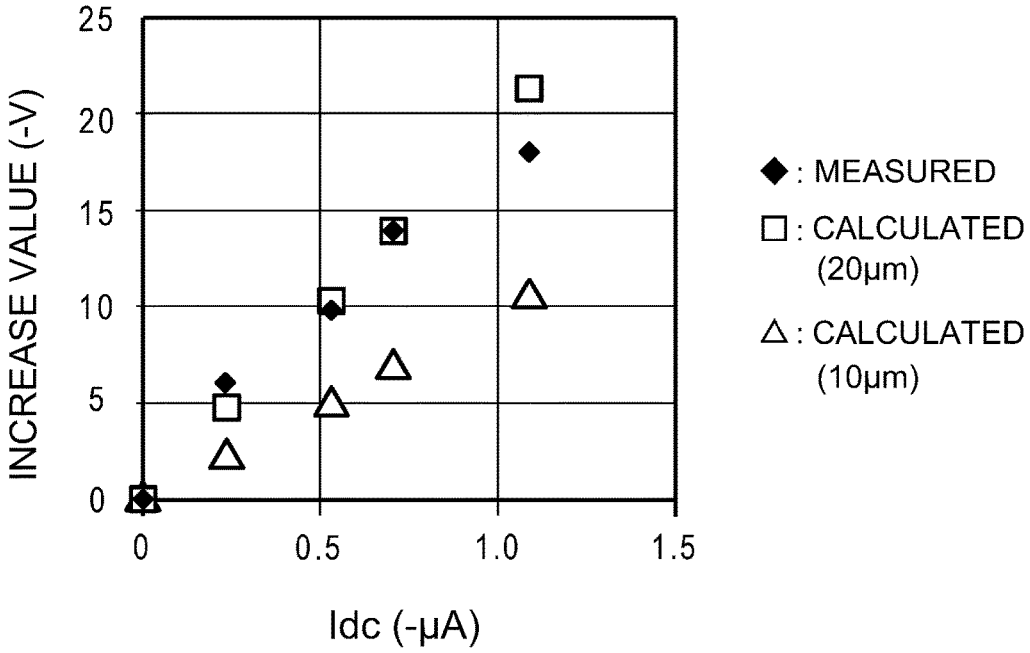
FIG. 11 is a graph showing a relationship between an injection current and a potential increase value of a photosensitive drum in an image forming apparatus according to Fifth Embodiment.
Figure 12:
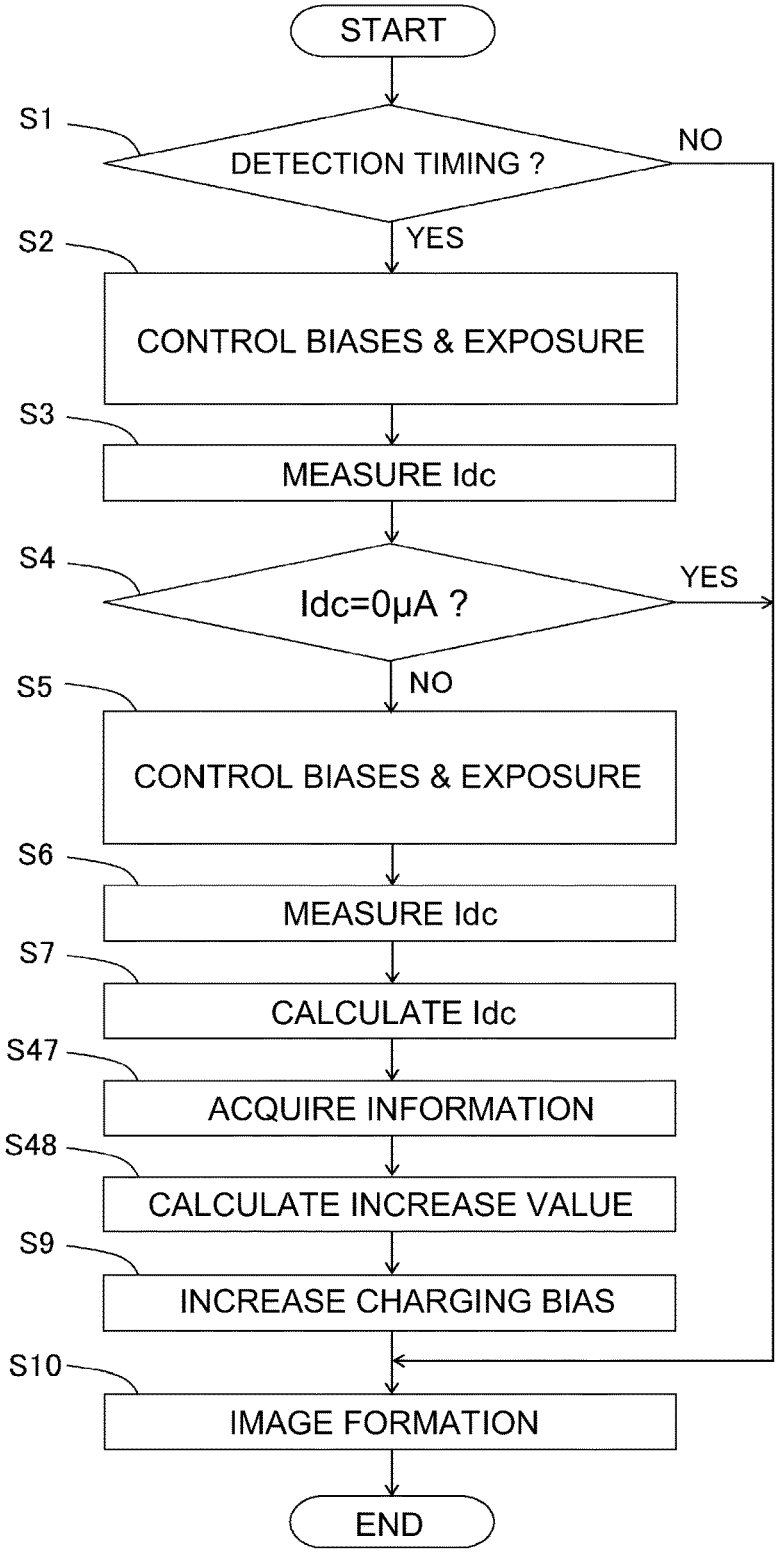
FIG. 12 is a flowchart showing a procedure when a charging bias is increased for suppressing lateral stripe generation in the image forming apparatus in Fifth Embodiment.

Fifth Embodiment of the present invention will be specifically described with reference to FIGS. 11 and 12. In this embodiment, the controller 11 controls the potential difference at the downstream charging gap portion Gd depending on an acquired injection current Idc and information on the photosensitive drum 51. Fifth Embodiment is different in constitution from First Embodiment in the above-described point, but other constitutions and control and the like are similar to those in First Embodiment, and therefore, represented by the same reference numerals or symbols and will be omitted from detailed description.

In this embodiment, the controller 11 controls the potential difference at the downstream charging gap portion Gd depending on a detected value of the injection current Idc and the information on the photosensitive drum 51. Further, in the ROM 72, an image forming control sequence for forming an image on the sheet S and a table (Table 2 below) or the like showing a relationship between the injection current Idc and a correction amount of a charging voltage when correction of preventing the lateral stripe is made are stored.

In this embodiment, after the injection current Idc is detected by applying the voltage not more than the discharge start voltage during non-image formation, the controller 11 reads the information on the photosensitive drum 51 from the memory 62 mounted in the image forming unit 50. Then the controller 11 calculates a potential increase amount from the information on the photosensitive drum 51. As the information on the photosensitive drum 51 stored in the memory 62, there are information on a thickness of the surface layer of the photosensitive drum 51, a rotation time of the photosensitive drum 51, a past use hysteresis of the photosensitive drum 51, and the like.

Here, a relationship between the information on the thickness of the surface layer of the photosensitive drum 51 and the lateral stripe rank will be described. In the above-described formula 2, in the case where the process speed, the dielectric constant of the photosensitive drum 51, and the width of the charging roller 52 are known values, the potential increase value is determined by the thickness of the surface layer of the photosensitive drum 51. That is, as shown in FIG. 11, even at the same injection current Idc, between the case where the surface layer of the photosensitive drum 51 has the thickness of 20 μm and the case where the surface layer of the photosensitive drum 51 has the thickness of 10 μm, the potential increase values acquired are different values in which one is about twice the other.

When the thickness of the surface layer of the photosensitive drum 51 disposed in the image forming apparatus 1 is always the same, the controller 11 of the image forming apparatus 1 may only be required to have thickness information on the surface layer of the photosensitive drum 51. However, there are various cases such as the case where, for example, thicknesses of surface layers of photosensitive drums 51 for respective colors in a color printer are different from each other and the case where surface layer thicknesses of photosensitive drums 51 are different from each other for respective destinations. Therefore, the information on the surface layer thickness of the photosensitive drum 51 is stored in the memory 62 provided in the image forming unit 50, and then the controller 11 reads the information from the memory 62, so that the image forming apparatus 1 is capable of meeting the different thicknesses of the surface layers of the photosensitive drums 51.

In the case where the surface layer thickness of the photosensitive drum 51 fluctuates by abrasion due to the rotation of the photosensitive drum 51, the above-described information may also be stored in the controller 11, but may also be stored in the memory 62 of the image forming unit 50.

In that case, as a formula for deriving the thickness, various approximate expressions would be considered depending on a process condition of the image forming apparatus 1. In the case simple linear approximation holds, when a surface layer thickness decreasing speed per one hour of the photosensitive drum 51 is α (μm/h) and an initial surface layer thickness of the photosensitive drum 51 is β (μm), a surface layer thickness y (μm) of the photosensitive drum 51 after a durability test of x hours is calculated by the following formula 3.

$$y=\beta-\alpha x \qquad \text{(formula 3)}$$

That is, the initial surface layer thickness β of the photosensitive drum 51 and the surface layer thickness decreasing speed (rate) α of the photosensitive drum 51 are stored in the memory 62 in advance, and the rotation time x of the photosensitive drum 51 is recorded on an as-needed basis depending on a use time through the controller 11. As a result, the controller 11 is capable of calculating a proper potential increase value depending on the use time of the photosensitive drum 51.

As described above, the injection current Idc of the charging roller 52 depends on the temperature/humidity environment in which the image forming apparatus 1 is installed, and increases with a higher temperature/higher humidity environment and decreases with a lower temperature/lower humidity environment. Such a change in temperature/humidity environment influences as a durability hysteresis of the photosensitive drum 51. This would be caused by a phenomenon that water in the air principally penetrates into the photosensitive drum 51 and an electric resistance lowers and thus an amount of the dark decay increases.

The photosensitive drum 51 left standing in the high temperature/high humidity environment for a long time worsens in lateral stripe level than a fresh (new) photosensitive drum 51 even when the injection current Idc is the same. For this reason, it is preferable that the controller 11 causes the memory 62 of the image forming unit 50 to store the detected temperature and humidity and the time and then switches the charging bias correction value depending on the information on the temperature and humidity and the time. In this embodiment, as shown in Table 5 below, depending on the time for which the photosensitive drum 51 is left standing in the high temperature/high humidity environment, the charging bias correction value corresponding to the potential increase value is changed. As a result, depending on the use hysteresis of the image forming unit 50, it becomes possible to optimize the charging bias correction value.

TABLE 5

| | | | | | | |
|---|---|---|---|---|---|---|
| PIV*1 (V) | | 0 | 5 | 10 | 15 | 20 |
| CVCV*2 (V) | 0 hr | 0 | 50 | 100 | 150 | 200 |
| | 100 hr | 0 | 55 | 110 | 165 | 220 |
| | 300 hr | 0 | 60 | 120 | 180 | 240 |
| | 500 hr | 0 | 65 | 130 | 195 | 260 |
| | 700 hr | 0 | 75 | 150 | 225 | 300 |
| | 1000 hr | 0 | 80 | 160 | 240 | 320 |

*1"PIV" is the potential increase value.

*2"CVCV" is the charging voltage correction value for the time for which the photosensitive drum 51 is left standing in the high temperature/high humidity environment.

Next, in the above-described image forming apparatus 1, a procedure of setting the potential of the photosensitive drum 51 during non-image formation before image formation on the basis of the injection current Idc and the information on the photosensitive drum 51 will be described with a flow chart shown in FIG. 12. In FIG. 12, steps S1 to S7, S9 and S10 are similar to those in First Embodiment and therefore will be omitted from detailed description.

In this embodiment, in the case where the two injection currents Idc are measured steps S3 and S6, on the basis of the two injection currents Idc, the controller 11 calculates the injection current Idc during image formation by using, e.g., the above-described formula 1 (step S7). The controller 11 acquires the information on the photosensitive drum 51, e.g., the thickness of the surface layer of the photosensitive drum 51 by making reference to the memory 62 of the image forming unit 50 (step S47). Then, on the basis of, e.g., the above-described formula 2, the controller 11 calculates the potential increase value of the photosensitive drum 1 during image formation by using the injection current Idc acquired by the formula 1 and the surface layer thickness of the photosensitive drum 51 (step S48). Then, the controller 11 increases and applies the charging bias so that, e.g., as shown in Table 2, the surface potential Vd of the photosensitive drum 51 increases with the increase in potential increase value due to the increase in acquired injection current Idc, and effects the exposure with the increased pre-exposure amount (step S9), and then executes the image formation (step S10).

As described above, also according to this embodiment, the controller 11 carries out the control in the following manner when the charging bias is less than the voltage at which the discharge starts between the photosensitive drum 51 and the charging roller 52 during non-image formation. In the case where the detected value by the current value measuring circuit 61 is out of a predetermined range, depending on the injection current Idc, the controller 11 sets the image forming apparatus capable of suppressing the lateral stripe. As a result, the generation of the charging lateral stripe can be suppressed without shortening lifetimes of the photosensitive drum 51 and the charging roller 52 and without increasing electric power consumption.

Further, according to the image forming apparatus 1 in this embodiment, the controller 11 causes the charging bias voltage source 60 to increase the charging bias, so that the potential difference between the photosensitive drum 51 and the charging roller 52 at the downstream charging gap portion Gd with respect to the rotational direction of the photosensitive drum 51 are increased. Further, the controller 11 calculates the potential increase value by using also the information on the photosensitive drum 51 in addition to the injection current Idc. For this reason, a proper potential increase value depending on an actual use status of the photosensitive drum 51 can be calculated, so that the generation of the charging lateral stripe can be suppressed more effectively.

Other Embodiments

In the above-described First to Fifth Embodiments, the potential difference at the downstream charging gap portion Gd is increased depending on the increase in charging bias, the increase in exposure amount of the exposure device 42 or the increase in process speed, but the present invention is not limited thereto. For example, the potential difference at the downstream charging gap portion Gd may also be increased by other methods. Or, of these methods, one or a plurality of methods may also be selectively executed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-130933 filed on Jun. 30, 2016, which is hereby incorporated by reference herein in its entirety.

What is claimed is:

1. An image forming apparatus comprising:

a photosensitive member on which an electrostatic latent image is formed;

a charging roller in contact with said photosensitive member and configured to electrically charge said photosensitive member;

a voltage source configured to apply only a DC voltage to said charging roller;

a detecting member configured to detect a current flowing from said charging roller into said photosensitive member; and a setting portion configured to set the DC voltage applied to said charging roller in an image forming period on the basis of a detection result of said detecting member when the DC voltage less than a discharge start voltage is applied from said voltage source to said charging roller in a period other than the image forming period, wherein said setting portion sets the DC voltage so that an absolute value of the DC voltage when an absolute value of the detected current is a first value is greater than an absolute value of the DC voltage when the absolute value of the detected current is a second value less than the first value.

2. An image forming apparatus according to claim 1, further comprising a storing portion configured to store information on said photosensitive member including at least one of information on a thickness of said photosensitive member, information on a cumulative rotation time of said photosensitive member and information on use hysteresis, wherein said setting portion sets the DC voltage on the basis of the information on the photosensitive member.

3. An image forming apparatus according to claim 1, further comprising an environment detecting portion configured to detect environment information including at least ambient temperature and ambient humidity of said photosensitive member, wherein said setting portion sets the DC voltage on the basis of the detected environment information.

4. An image forming apparatus according to claim 1, further comprising:

an exposure member configured to expose a surface of said photosensitive member to light on the basis of image information to form the electrostatic latent image including an image portion and a white background portion; and a developing device configured to deposit toner only on the image portion of the electrostatic latent image formed on said photosensitive member, wherein said setting portion sets an amount of exposure of the white background portion to light when the absolute value of the detected current is the first value to be greater than that when the absolute value of the detected current is the second value less than the first value.

* * * * *